US009120029B2

(12) United States Patent
Poulsen

(10) Patent No.: US 9,120,029 B2
(45) Date of Patent: Sep. 1, 2015

(54) BUILDING ELEMENTS FOR BUILDING THREE-DIMENSIONAL STRUCTURES, AND METHODS FOR ASSEMBLING THE BUILDING ELEMENTS

(75) Inventor: Ole Vestergaard Poulsen, Vejle (DK)

(73) Assignee: Mad House A/S, Middelfart (DK)

( * ) Notice: Subject to any disclaimer, the term of this patent is extended or adjusted under 35 U.S.C. 154(b) by 678 days.

(21) Appl. No.: 13/263,140

(22) PCT Filed: Mar. 26, 2010

(86) PCT No.: PCT/DK2010/050069

§ 371 (c)(1),
(2), (4) Date: Nov. 11, 2011

(87) PCT Pub. No.: WO2010/115429

PCT Pub. Date: Oct. 14, 2010

(65) Prior Publication Data

US 2012/0055000 A1 Mar. 8, 2012

(30) Foreign Application Priority Data

Apr. 6, 2009 (DK) ..... 2009 00462
Jan. 19, 2010 (DK) ..... 2010 70016

(51) Int. Cl.
*A63H 33/08* (2006.01)
*A63H 33/10* (2006.01)

(52) U.S. Cl.
CPC ..... *A63H 33/084* (2013.01); *A63H 33/105* (2013.01); *A63H 33/101* (2013.01); *Y10T 29/49826* (2015.01)

(58) Field of Classification Search
CPC ..... B21D 53/00; B21B 1/082; A63H 33/04; A63H 33/08; A63H 33/10; A63H 33/084; A63H 33/101; A63H 33/105; Y10T 29/49826; Y10T 29/49623
USPC ..... 29/897.3, 412; 446/85, 97, 101, 108, 446/111, 122, 124; 52/698, 712
See application file for complete search history.

(56) References Cited

U.S. PATENT DOCUMENTS 2,708,329 A * 5/1955 McKee ..... 52/286
2,968,118 A * 1/1961 Paulson ..... 446/105

(Continued)

FOREIGN PATENT DOCUMENTS

EP 1642630 4/2006
EP 1671687 6/2006

(Continued)

*Primary Examiner* — Sarang Afzali
(74) *Attorney, Agent, or Firm* — Mollborn Patents, Inc.; Fredrik Mollborn

(57) ABSTRACT

This invention describes a set of building elements comprising a uniting plate (1) and a base plate (19). The uniting plate (1) comprises two plates (3) defined in a single plane, said two plates (3) are connected in a connection line (9), and a slot (5) is placed at said connection line; said slot (5) may engage with a slot on another uniting plate (1) to obtain uniting plates with their plates (3) in different planes. The base plate (19) being substantially planar having three parallel plates, which is placed in two planes, where the first (117) and third plate (119) is placed in one plane, are arranged on either side of the second plate (121), which is placed in the second plane, and where the two parallel planes define a space between the two planes to obtain one of the plates (3) of the uniting plate (1). The base plate (19) comprises locking means for interacting with one of the plates (3) of the uniting plate (1); said locking means comprises at least two parts, where the at least two parts are at the first and third plate, respectively and where one of the plates (3) of the uniting plate (1) can be placed between the two planes. The set of building elements may be used in areas like toys, furniture and decorative arts to obtain three-dimensional structures.

17 Claims, 28 Drawing Sheets

(56) References Cited

U.S. PATENT DOCUMENTS

| | | | | |
|---|---|---|---|---|
| 4,365,454 | A | 12/1982 | Davis | |
| 2006/0080928 | A1* | 4/2006 | Kichijo et al. | 52/596 |
| 2009/0092774 | A1* | 4/2009 | Kichijo et al. | 428/33 |

FOREIGN PATENT DOCUMENTS

| | | |
|---|---|---|
| EP | 2025379 | 2/2009 |
| WO | 2007136047 | 11/2007 |

* cited by examiner

BUILDING ELEMENTS FOR BUILDING THREE-DIMENSIONAL STRUCTURES, AND METHODS FOR ASSEMBLING THE BUILDING ELEMENTS

This application claims the benefit of Danish Application No. PA 2009 00462 filed Apr. 6, 2009, Danish Application No. PA 2010 70016 filed Jan. 19, 2010, and PCT/DK2010/05006 filed Mar. 26, 2010, which are hereby incorporated by reference in their entirety as if fully set forth herein.

FIELD OF THE INVENTION

The present invention concerns a set of multiple building elements which can be combined in various three-dimensional structures according to the wish of the builder. The set of building elements may be used in areas like toys, furniture, and decorative arts.

BACKGROUND OF THE INVENTION

The human brain is stimulated by creative processes. However, the creative skills differ among persons. During their bringing up, children are stimulated by creative processes and they learn and develop during playing.

Children's fantasy is enormous. One of the games that many children enjoy is the combination of different building elements into different structures like castles, airplanes, cars and so forth in order to play different games developed by their imagination. Multiple systems have been developed in order to create new building elements. By way of example of one popular system, small magnetic sticks and balls are combined into different geometric figures in three-dimensions. However, the disadvantage of this system is a high level of instability, especially for creating sophisticated geometrical structures. Furthermore, the size of the elements may cause a health risk as especially children will tend to put the colourful elements in the mouth.

In another system, building bricks can be used for the creation of three-dimensional structures. The bricks can be combined in various ways to create different types of toys like cars, animals and so forth. However, multiple different types of bricks are needed to create more sophisticated structures. Furthermore, the building bricks are, because of their shape none-flexible and only capable of creating edged structures. Thus, the bricks are stackable and not capable of forming real three-dimensional figures.

OBJECT OF THE INVENTION

It is the object of this invention to create a set of building elements, which provide stable and safe three-dimensional structures and which are capable of building complex three-dimensional structures with only a minimum of different types of elements.

DESCRIPTION OF THE INVENTION

This invention addresses these problems by creating a set of building elements comprising

- a uniting plate; said uniting plate comprises at least two flanges defined in a single plane, said at least two flanges are connected by a first connection line, and said first connection line comprises at least a first slot; said slot may engage with a second connection line on another uniting plate to provide uniting plates with their respective flanges in different planes;

- a base plate; said base plate being substantially planar having three parallel planes, where the first and third planes are arranged on either side of the second plane, where said second plane is substantially open apart from connection members connecting the first and third plane, and said base plate comprises at least one means for interaction with the flange of the uniting plate; said means for interaction comprises at least two parts, where the at least two parts are in the first and third plane, respectively such that one of the flanges of the uniting plate can be placed in the second plane.

Overall, through the description the term plate is to be interpreted as an element where the thickness is much smaller than the height and width.

This unique design of these two building elements enables multiple creations to be made. The two or more flanges of the uniting plate are each able to combine to means of interaction of two or more different base plates, thus uniting at least two separate base plates. The uniting plate can then further be combined with another uniting plate by engaging the slot of the connection line between the flanges of the uniting plates. The slot can for example be arranged from the middle of the connection line and outwards along the connection line to the edge of the two flanges. In this way, two uniting plates can easily be combined by engaging the slots with one another through the openings at the edge of the plate. However, other types of arrangement of slots are possible depending on the shape of the flanges of the uniting plates. Important is that the arrangement of the slot enables the combination of one or more uniting plates. That is not only two but more uniting plates can be combined to form a star-like structure.

The term connection line is to be interpreted as a line with a geometrical extension in the single plane of the uniting plate.

Furthermore, the uniting plates to be combined can be of different embodiments in order to obtain further options for combinations with base plates. Thus, for example the shape of the flanges can be formed as for example squares, rectangles, half-circles, half a star, etc.

Combining different uniting plates leads to plates in different planes, and thus the ability to combine base plates in different planes, whereby three-dimensional structures can be created. Depending on the number of means of interactions of the base plate the structure can progress to have an extent in numerous directions/planes since the means of interaction can be arranged in any given distances and/or angles to one another.

The base plate comprises three parallel planes in order to create the means of interaction. The outermost two planes are the first and third plane, which are arranged on either side of a second plane. The second plane is almost empty except for connections between the first and third plane in order to combine the two planes. In addition, these connections between the first and third plane serves as borderlines for the means of interactions and borders for the flange of the uniting plate. The second plane is except for the connections empty since this plane is the receiving plane of the base plate. Hence, the second plane is the plane into which the flange of the uniting plate is introduced. After introducing the flange of uniting plate into the base plate the flange is at least partly surrounded by the first and third plane like an envelope where the opening flap is inserted in between the connection on the back of the envelope. In contrast to a normal envelope the material of the first and third plane surrounding the flange of the uniting plate can be either fully unbroken or divided into parts where the material only covers subparts of the plane, leaving parts of the flange visible when looked upon from either the first or third plane, respectively.

As another embodiment the uniting plate can be provided with a third flange in an angle perpendicular to the single plane of the uniting plate. The third flange is, similar to the base plate, divided into three planes, where the first and third plane are arranged on either side of a second plane, where the second plane is nearly empty except for connections between the first and third plane. The third flange of the uniting plate thus constitutes an envelope function, which can be engaged for example with a flange of an inner wheel part or further base plates.

The flange of the inner wheel part is alike spokes of a wheel. One or more flanges of the inner wheel part are connected at one end with a hub and at the other end they can be connected with the third flange of the uniting plate. The flanges of the inner wheel part can be made from different sub-elements in order for the flanges to obtain further degrees of flexibility.

Base plates can be arranged between the flanges of the inner wheel and connected together with uniting plates in order to create the surface of the wheel. In particular, base plates of a rectangular shape with only two means of interaction arranged on either of the longer sides of the rectangle are preferred. However, means of interaction can be arranged at the short sides of the rectangle as well. Hereby, multiple wheels can be connected. The wheels can also be connected by connecting the wheel through the hub using an axis. This axis can be shaped in any manner, which can provide an interaction with the inner of the hub and preferable provide wheels to rotate simultaneously.

In an advantageous embodiment the means for interaction of the base plate comprises two outermost parts and a middle part, where the two outermost parts are in the first plane, while the middle part is in the third plane. In a further advantageous embodiment, the two outermost parts are connected with a stabilising element, where the stabilising element is arranged in the first plane.

This particular embodiment is known as a vertical envelope function. The flange of the uniting plate is easily arranged between the parts of the means for interaction and is still releasable retained though support of the outermost parts of the flange is only provided by the material in the first plane while the middle part of the flange is only supported by material in the third plane. It is to be understood that the definition of the first and third plane is use arbitrarily throughout the description and that in this case the outermost part could as well be arranged in the third plane while the middle part could be arranged in the first plane.

In this embodiment, the flange of the uniting plate is engaged with the means of interaction in a direction that follows parallel with the division between the parts. Other similar embodiments are a horizontal envelope where the flange of the uniting plate is engaged with the means of interaction in a direction that is perpendicular to the division between the parts of the means of interaction of the base plate. Still, another embodiment is a diagonal envelope where the flange of the uniting plate is engaged with the means of interaction in a direction that is neither parallel nor perpendicular to the division between the parts of the means of interaction of the base plate.

Another advantage of these particular embodiments is that the base plate is less material demanding when the means of interaction of the base plate is divided into parts. In addition, the base plate can be formed from one plate of material alone.

Additionally, an embodiment, which is a combination of a vertical and horizontal envelope, is an option. This embodiment comprises a middle part as seen for the vertical envelope; however the middle part is shorter than for the vertical envelope. A stabilising element (a bridge) connects the two outermost means of interactions and is arranged in the same plane as the two outermost means of interactions. Hence, the uniting plate is engaged with means of interaction in a direction both perpendicular and parallel to the division between the parts of the means of interaction of the base plate. The stabilising element is preferably arranged at the part of the means of interaction to be first in contact with the flange of the uniting plate during engaging of the uniting plate with the base plate.

The connecting bridge stabilises the two outermost means of interaction as well as the connection of the base plate and uniting plate. The two outermost means of interaction are not as easily damaged or destroyed when engaging or disengaging the base plate and the uniting plate. Hereby, the safety and sustainability of the building elements are increased.

The stabilising element can be of any size or shape such as a rectangle of varying width, half-circles, circles, or coils as long as it connects the two outermost parts and hereby stabilises the two outermost parts in order to prevent damage hereto during connection between the base plate and the uniting plate. The stabilising element can be arranged at any given position between the two outermost parts i.e. either at the edge of the base plate, close to the centre of the base plate or anywhere therein between.

In a further advantageous embodiment, the flanges of the uniting plate are in a triangular shape and that the means for interaction of the base plate are in a triangular shape.

It is important for all shapes that the flanges of the uniting plates and the means for interaction of the base plate are designed to fit properly. Thus, if the flanges of the uniting plate are in a triangular shape the shape of the means for interaction has to be triangularly shaped as well. It is possible that some geometrically different shapes fit together and can be releasable retained like a triangularly shaped flange of a uniting plate with means for interaction shaped as a rectangle. Hereby, the amount of components that can be combined increases. It is however preferred to combine flanges of uniting plates and means of interaction of base plates with similar shaped e.g. triangles.

When the flange of the uniting plate and the means of interaction of the base plate are triangularly shaped, the combination of the two parts begins with joining a minor apex of the flange of the uniting plate with the larger bottom of the means of interaction of the base plate. Hence, it is relatively easy to combine the base plate and the uniting plate. Furthermore, the correct insertion is guided by the sides (i.e. the connections between the first and third plane) of the means of interaction of the base plate. When combining for example two elements shaped as rectangles the starting point is a flange of the uniting plates with a size that fits exactly to the size of the means of interaction of the base plates. Thus, the joining has to be more precise. Hence, it is harder to combine flanges of uniting plates and means of interaction of the base plate when shaped as rectangles than as triangles. Especially, for children this would be difficult to perform.

In a still further advantageous embodiment, the base plate comprises four means for interaction; said means for interaction are arranged to form a quadrangle.

Combining four triangularly shaped means of interaction of the base plate with their apexes together forms a square which is easily handled as well as relatively stable. Furthermore, the flanges of the uniting plates are arranged with the apex of the triangularly shaped flange at the centre of the base plate. Thus, the strength of the base plate to resist rupture when joined with the uniting plate is highly increased both perpendicular to the plate as well as parallel to the plate.

If the means of interactions of the base plate are divided into parts like previously described with two outermost parts and a middle part the arrangement of the parts in the first and third plane can with success be alternated in the four means of interaction. In this way, the middle part of the two means of interaction opposite of one another can for example be in the first plane while the middle part can be in the third plane in the other two means of interaction. This highly increases the stability and function of the base plate. By alternating the part in this manner, connections between the first and third plane can easily be created during the process of manufacturing. The connections help correcting and adjusting the combination of the flange of the uniting plate and the means of interaction of the base plate.

In a still further advantageous embodiment, one of the flanges of the uniting plate in relation to the other flange has an extend in the single plane, which is negligible.

This embodiment of the uniting plate is valuable for the creation of corners. The uniting plate of this embodiment comprises two flanges, however, one of the flanges are reduced to only a minor flange, which is not capable of combining efficiently with the means of interaction of a base plate. Combining two uniting plates of this embodiment results in the formation of a corner since only two major flanges—one from each uniting plate—are able to combine with base plates while the two minor flanges—one from each uniting plate—are left. To form a smoother corner, the minor flanges can be modified for example by the addition of a hat to the top where the hat of two minor flanges by combination engages planes on either side of the corner. The hat can preferably be shaped as an element on the edge of the minor flange parallel to the connection line of the minor flange where the planer element comprises two sloping elements on either side of the minor flange.

The minor and major flanges are arranged on either side of the connection line. The geometrical extension of the connection line is in this embodiment as large as to be able to include ridges (as described elsewhere).

In a still further advantageous embodiment the connection line comprises flexible material.

Flexible characteristics of the connection line enable the flanges of the uniting plate to be able to bend with regard to the other flange. Thus, the two flanges are able to form an angle different from 180 degrees with respect to the plane of one another. For the process of creation, this implies that the angles of the creations are able to differ from 180 degrees and 90 degrees. By using uniting plates comprising rigid connection lines alone, one uniting plate would combine two base plates at an angle of 180 degrees between their planes while two combined uniting plates would be able to combine four base plates at an angle of 90 degrees between their planes.

A uniting plate comprising a flexible connection line is capable of bending the flanges of the uniting plate in relation to one another at any angle between 10 degrees and 350 degrees between the two flanges.

The flexible material can be used both in uniting plates comprising two flanges capable of interaction with the means of interaction of the base plate or with a uniting plate comprising only one flange capable of interaction with the means of interaction of the base plate combined with a minor flange.

In a still further advantageous embodiment, the uniting plate comprises ridges arranged parallel to the connection line.

The part of the connection line defined by the slot makes it difficult to keep the two uniting plates at place after their combination. Adding one or preferably two ridges parallel to the connection line on one or both sides of the uniting plate helps to control the movements of the parts of the flanges situated on either side of the slots. The distance between two ridges on either side of the connection line preferably corresponds to the thickness of the plates. Thus, the two parts on either side of the slot are releasable fastened during the combination of the uniting plates by sliding them along the ridges.

In an advantageous embodiment the connection line of said uniting plate comprises at least one opening and said slot comprises at least one elevation where said at least one elevation of a first uniting plate engages with said opening of a second uniting plate when obtaining uniting plates with their respective flanges in different planes.

The opening(s) of the connection line can be of any shape such as circular, rectangular, oval and can be either a depression in the connection line or penetrate through the connection line. However, preferably the at least one elevation present on at least one of the sides of the slot is comparative hereto in order to secure the most efficient connection when engaging two uniting plates. Furthermore, a series of openings, possibly of different size, shape and penetration depth, can be present in the connection line depending on how secure the connection between the engaged uniting plates are to be.

Elevations are preferably present on both sides of the slot i.e. the sides of the uniting plate approaching the slot but elevations can be present on one side only, or in an alternating manner between the sides if a series of openings are to be engaged with.

In a still further advantageous embodiment, the set of building elements further comprises a corner element; said corner element comprises two sub-plates arranged in separate intersecting planes, where the sub-plates each comprises three parallel planes, where the first and third planes are arranged on either side of the second plane, where said second plane is substantially open apart from connection members connecting the first and third plane, and said sub-plates comprises at least one means for interaction with the flange of the uniting plate; said means for interaction comprises at least two parts, where the at least two parts are in the first and third plane, respectively.

The corner element is an alternative to the uniting plate with one minor flange and one major flange in order to create a corner in the formed three-dimensional structure. The corner element can be engaged with one of the flanges of a uniting plate through the means of interaction of the corner element.

The corner of the created structure is formed by the corner element. The two subplates in the intersecting planes can be combined either by bending one plate to form the two sides of the corner element or by combining two plates.

The shape of the corner is given by the angle between the two sides of the corner element i.e. between the two subplates. Corner elements with different angles are preferred but the angle can also be differed by combining the two sides of the corner element by a flexible material.

In a still further advantageous embodiment, the base plate is formed as a rectangle.

The rectangular base plate comprises two shorter parallel sides and two longer parallel sides. The preferred embodiment of the rectangular base plate comprises means of interaction only at the two shorter parallel sides. However, other embodiments of the rectangular base plate comprise one or more means of interaction in the two longer parallel sides.

The rectangular base plate can for example be used together with two square-formed base plates for building triangles where the hypotenuse of the triangle is known to be longer than the catheters. Sets of building elements comprising base plates of size according to the theorem of Pythagoras capable of fitting as both catheters and hypotenuses are highly advantageously.

In a further advantageous embodiment, the uniting plate comprises an aperture and a ridge is provided in the means for interaction in the base plate, whereby said aperture engages with the ridge in the base plate, whereby said base plate and said uniting plate are releasable locked together. In a still further advantageous embodiment, the ridge is arranged on a resilient section of the means for interaction, and furthermore that a release means for urging the resilient section away from the uniting plate may be provided.

A retained combination of a flange of a uniting plate with the means of interaction of a base plate during the time of creation of the design and possibly during the lifetime of the design is increased by the addition of a locking mechanism. The locking mechanism, however, is importantly a combination between retaining the uniting plate and base plate together and not locking the connection to a larger extent than the combination is readily releasable when the two parts are pulled apart. The pulling apart has to be easy even for children.

Alternatively, the ridge can be pushed when pulling the uniting plate in order to release the uniting plate from the base plate more easily. Additionally, a part of the means of interaction of the base plate can be designed e.g. with a small knob or a raised front part. By grapping around the small knob and hereby slightly lifting or by arranging one or more fingers under the raised front part and hereby slightly lifting, this part of the means of interaction can be slightly elevated and the ridge be disengaged with the aperture whereby the base plate and uniting plate easily can be pulled apart.

The function of the locking mechanism is as follows: When the flange of the uniting plate is slid into the second plane of the base plate, the uniting plate is slightly pushed to overrun the ridge in the first plane before the aperture of the flange of the uniting plate engages with the ridge and releasable locks the uniting plate and the base plate. It is important that the ridge is shaped to encourage the flange to easily slide above the ridge until the ridge engages with the aperture. Similarly, the size of the aperture is to fit with the size of the ridge.

The ridge on the base plate can be arranged at any given place in the means for interaction as long as the aperture of the uniting plate is arranged on the flange of the uniting plate at a position that enables locking between the ridge and the aperture. Preferably, the aperture is arranged complementary to the ridge i.e. the locking between the aperture and ridge is performed when the flange of the uniting plate is inserted completely in the means of interaction.

The locking mechanism can preferably be combined with a release mechanism and a resilient layer around the ridge. Thus, the locking mechanism can be stronger since the uniting plate and base plate is not to be pulled from one another. In this manner, the release mechanism for example is pushed and compresses the resilient layer and hereby the ridge, whereby the ridge is disconnected from the aperture of the flange of the uniting plate and it can easily be pulled away from the base plate. The release mechanism can as well be pulled, twisted or bend. As an alternative the release mechanism can be activated by means like sound, electricity, or light. In this manner, a receiver unit is integrated into the release mechanism while a transmitter mechanism is provided to function without physical contact with the release mechanism. The resilient layer can be a layer, which can be either compressed or which includes a small spring in order to lift the flange of the uniting plate of the ridge of the base plate.

In a still further advantageous embodiment, the set of building elements comprises a first play figure; said first play figure comprises a head, two arms, two hands, two legs, and a torso; where the hands are formed as flanges which can engage with the apertures of the uniting plate; and where the legs are separated by a space; said space is shaped complementary to the shape of the head of the first play figure; and where the first play figure can be detachably engaged with another first play figure by placing the head of one first play figure in the space between the legs of another first play figure.

The first play figure can be designed in multiple shapes and colours for example as a man from outer space or a cowboy. In this way, pyramids with differently looking first play figures can be combined into gigantic three-dimensional figures. The combination is performed by the combination of the head of one first play figure into the space between the legs of another first play figure. The space has a size and shape such that the head will be held with tension in the space. In this way, multiple figures can be placed on top of one another. The space complementary to the head is not restrained to be arranged between the legs. As an additional feature the space can comprise small ridges or similar features in order to retain the head of another first play figure.

The first play figures can additionally be combined with the apertures of the flanges of the uniting plates. However, this is not essential. The combination forms between the hands of the first play figure and the aperture of the flanges of the uniting plates by engaging the hands with the apertures. Preferably, the hands include small ridges for the first play figure to be releasable retained with the uniting plate.

This implies that combining two uniting plates, two first play figures can be combined hereto and thus, two rows of first play figures can be created. Combining with more uniting plates enables further rows of first play figures to be combined.

In a still further advantageous embodiment, the set of building elements comprises a second play figure; said second play figure comprises at least one head similar to the head of the first play figure, at least one torso, at least two legs and multiple arms; where spaces are arranged on the second play figure; said spaces are shaped complimentary to the head of the first play figure; and where the second play figure can be detachably engaged with the first play figure or another second play figure by placing the head of the first play figure or the other second play figure in the space of the second play figure.

The second play figure can be combined with multiple first play figures, second play figures or apertures of the flanges of uniting plates, or more likely a combination hereof. Hereby, multiple designs can be achieved. The second play figure can be designed in multiple shapes and colours for example as a man from outer space or a cowboy.

The space complementary to the head is not restrained to be arranged at any specific positions. As an additional feature the spaces can comprise small ridges or similar features in order to retain the head of another first or second play figure.

The second play figures can additionally be combined with the apertures of the flanges of the uniting plates. However, this is not essential. The combination forms between the hands of the second play figure and the aperture of the flanges of the uniting plates by engaging the hands with the apertures. Preferably, the hands include small ridges for the first play figure to be releasable retained with the uniting plate.

This implies that combining two uniting plates, two second play figures can be combined hereto, or alternatively one second play figure and one first play figure can be combined hereto.

In a still further advantageous embodiment, the building elements are made from plastic, metal, glass, wood, ceramics, or a mixture of one or more of the components.

The building elements can with advantage be made from plastic materials like polyethylene, polyvinylchloride, polypropylene, polyacetal, polycarbonate, acrylonitrile butadiene styrene (ABS). Other types of plastic materials that are relevant are intelligent plastic materials which are for example plastics of which change their colour or/and stiffness in relation to changes in temperature.

This is an inexpensive type of material, where the flexibility of the plate itself can be regulated with regard to the type of plastic chosen. Furthermore, the plastic is easily cleaned, which is especially important when used in toys for children.

For similar and other purposes the use of metals like aluminium, cupper, and steel is preferred. Furthermore, different types of woods like rowan, beech, conifer, and MDF-plates as well as different types of glass and ceramics can be used for the manufacture of the different plates of the invention.

The types of material can be combined in different ways. As an example the uniting plate can be made of a plastic while the base plate can be made of a metal. Alternatively, the base plate itself can be made from different types of materials as for example metal and plastic. This is especially advantageous if the plates are combined to form a lamp. In this case a battery can be inserted into one end of the creation while the bulb is inserted in the other end. With the right combination of materials no wires are needed in order for the lamp to function.

Furthermore, a method of combining the building elements is described comprising the following elements

- a uniting plate; said uniting plate comprises two flanges defined in a single plane, said two flanges are connected by a connection line, and said connection line comprises a slot; said slot may engage with a slot on another uniting plate to obtain uniting plates with their respective flanges in different planes;
- a base plate; said base plate being substantially planar having three parallel planes, where the first and third planes are arranged on either side of the second plane, where said second plane is substantially open apart from connection members connecting the first and third plane, and said base plate comprises at least one means for interaction with the flange of the uniting plate; said means for interaction comprises at least two parts, where the at least two parts are in the first and third plane, respectively and where one of the flanges of the uniting plate can be placed in the second plane.

To create different three-dimensional designs using the building elements of this invention involves combining different base plates with means of interaction with flanges of uniting plates. The flanges are slid into the second plane of the base plate between the first and third plane, similar to an envelope function. Hereby, the uniting plate and the base plate are combined. The other flange of the uniting plate can be combined with another base plate. Combining the uniting plate with another uniting plate through the slot at the connection line between the flanges enables the combined two uniting plates to engage with four base plates. These base plates can be engaged with still other combined uniting plates, which again interact with further base plates. In this way, multiple base plates and uniting plates can be combined. Depending on the types of uniting plates, which can vary as described above as well as different types of base plates, figures and structures of different shape can be created.

The use of a set of building elements as previously described for toys, decorative art, or furniture.

This invention can be used as a set of building elements for children. The different elements can be combined in for example a package with a predefined figure to be created and thus, a specific number of elements of each different type. The elements can also be combined one, two or three types of elements in one package leaving the structure to be created optional.

Similar principles can be the case for the creation of furniture like small shelves, tables, small boxes and different types of stationeries as well as decorative arts like bowls, lamps. It is imaginable that a package with a predefined bowl can be predefined but that perhaps different types of bowls can be created anyhow.

In an advantageous embodiment, at least one building element comprises at least one electronic conductor; said at least one electronic conductor is arranged on said at least one building element in an engaging pattern, whereby said at least one first electronic conductor on a first building element can engage to at least one second electronic conductor on a second building element by combining said building elements. In a further advantageous embodiment, at least one of said building elements of said set of building elements further comprises a front plate and preferably, that said front plate is arranged substantially parallel to the first or third plane of said base plate.

Furthermore, a method is described, where said uniting plate comprises at least one first electronic conductor and said base plate comprises at least one second electronic conductor, where said at least one first electronic conductor and said at least one second electronic conductor engage during combination of said uniting plate and said base plate, whereby electrical power and data signals can be transferred from one plate to another.

The building elements can be provided with electronic conductors formed as connectors in order to be able to transfer an electrical power and data signals from one building element to another. The electronic conductors are to be arranged in a specific geometrical pattern in order for an electrical signal to be transferred efficiently between the separate building elements. The design of the specific pattern depends upon the shape of the building element as well as the ways of combination of the building elements. Preferably, the electronic conductors comprise an anode and a cathode, which are arranged in a manner that allows them to engage with an anode and a cathode on another building element i.e. a first anode and a first cathode on a first building element engages with a second anode and a second cathode on a second building element during the combination of the first and second building element.

These building elements can then be further combined with a third building element, whereby the third anode and third cathode of the third building element engage with the second anode and the second cathode of the second building element or with the first anode and the first cathode of the first element. These building elements can then be further combined with more building elements in order to obtain a specific two- or three-dimensional structure.

The electronic conductors can be made from different types of conducting material. It can for example be wires, which are placed on top of the building elements. Preferably, the wires are of a thin material like a foil, a metallic cover on building elements made from plastic, or the wires can be arranged into grooves cut into the surface of the building elements. Alternatively, the conducting material can be embedded into the building elements or the electronic conductors can be created by SMART-INK technique. The conductors can in an alternative embodiment for the invention be plated on the contact surfaces by a chemical process followed by an electro plating process known from the production of printed circuits.

Furthermore, a front plate can be arranged on top of the building elements for example substantially parallel with the first plane of the base plate. However, the front plate can be arranged in any given angle or place in relation to the building elements as long as the engagement with the building elements is sufficient to supply electrical power and data signal to the front plate, whereby an illustration on the front plate can be obtained. Preferably, the front plate is made from light emitting diodes (LEDs), organic light emitting diodes (OLEDs) or by SMART-INK. If sufficient data can be trasmittet to the front plate the front plate can be used as a game display or operate as a video or television screen.

When combining the separate building elements it is essential that the combination is fit in a manner that prevents the two building elements to be moved substantially in relation to one another when the structure is created. If the building elements are moved in relation to one another in a direction different from the direction for engaging/disengaging the building elements the cathodes and anodes can by change engage and cause a short-circuit. In addition, the engagement between cathodes and anodes on separate building elements can be interrupted and the transfer of the electronic signal destroyed. The design of the envelope function as described previously and the engagement between base plates and uniting plates is an example of a fit connection, which prevents the movement of the base plate and the uniting plate in relation to one another in directions other than the direction of the uniting plate sliding into the envelope of the base plate.

Multiple electronic conductors can be arranged on the building elements in several paths. The electronic conductors can conduct not only electronically signals from one building element to another but also audio or video signals. In this manner, sound can be transferred from one building element to the next to be amplified through a loudspeaker or displayed at a screen. It is possible to combine data and power in only the anode and cathode connections by using pulse modulation, where power is transmitted in the pulses and in periods of no pulsing.

The separate building elements of the two- or three-dimensional structure can be a combination of building elements comprising electronic conductors as well as building elements without electronic conductors. In this manner, structures can be created, in which an electronic signal can be transferred in a given direction, or only in part of the structure.

The structure can be connected to an energy source by connecting the building elements to a computer unit, the electrical grid or a battery. The computer unit can be a personal computer, which at least one building element is connected to, possible through a USB connection. However, the computer unit can as well be a slave unit only capable of transferring information from a CD/DVD or a USB-key and to the building elements. Alternatively, information can be transferred by Bluetooth or other wireless methods from another computer unit and to the slave computer unit in connection with the building elements. Additionally, a slave computer unit comprising at least one computer game or at least one puzzle or a mixture hereof, can be provided together with building elements in one package.

A computer game can be displayed on multiple front plates at once either as a single screen divided into multiple front plates, with a similar illustration on each screen, the structure can consist of building elements with one front plate alone, or different scenes of a computer game either different levels like the basement in a first front plate, the ground level on a second front plate and the first floor on a third front plate. Moving from one level to the next, thus, do not change the output of a given front plate the actions is moved to another front plate.

Similarly a puzzle can be created by combining multiple building elements, preferably comprising front plates. The building elements have to be combined in a specific manner in order to result in a continuous picture similar to a regular puzzle. The illustration of the separate building elements are only highlighted when the building elements are combined and an electronically signal is obtained. Hence, the illustrations of the separate building elements have to be remembered for later when detached from the structure. Alternatively, the illustrations of the building elements are visible and can be at least partly illuminated by combination with the structure. Alternatively or in addition, sound can be played for example as a fanfare, when a building element is correctly placed and/or when the puzzle is correctly assembled.

DETAILED DESCRIPTION OF THE INVENTION

Figure 1:
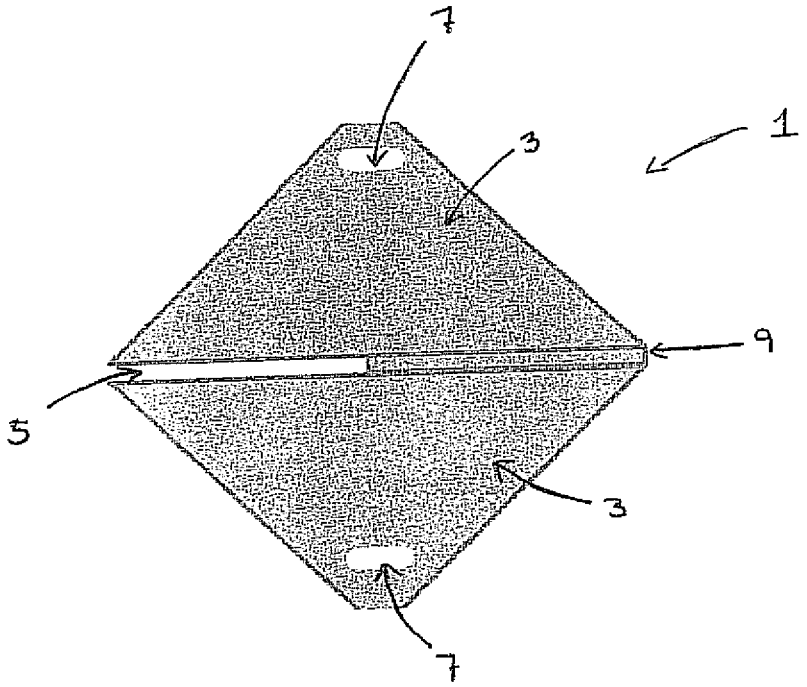
FIG. 1 illustrates a front view of a uniting plate.

FIG. 1 illustrates a uniting plate comprising two flanges 3 of a triangular shape in a single plane. The two flanges 3 connect at a connection line 9, which includes a slot 5. The slot 5 can be combined with the slot of another uniting plate in order to form two plates with their planes in different levels. An aperture 7 may be arranged at the top of each triangularly shaped flange 3.

Figure 1A:
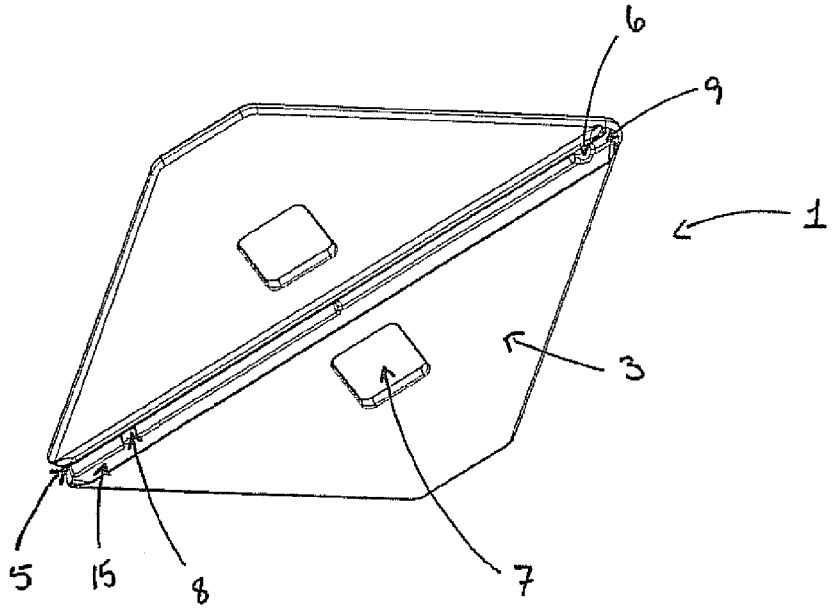
FIG. 1A illustrates an alternative embodiment of a uniting plate.

FIG. 1A illustrates an alternative embodiment of the uniting plate 1 as illustrated in FIG. 1. In this embodiment, the uniting plate 1 comprises ridges 15 on both sides of the connection line 9. Furthermore, the uniting plate 1 is provided with an opening 6 in the connection line 9. The opening 6 is in this particular embodiment circular. In the slot 5 of the uniting plate 1 small elevations 8 are present opposite of one another on both sides of the slot 5.

Combining two uniting plates 1 as illustrated in FIG. 1A results in that the elevations 8 of the first uniting plate 1 engage with the opening 6 of the second uniting plate 1, while the elevations 8 of the second uniting plate 1 engages with the opening of the first uniting plate 1. Hereby, the uniting plates 1 are secured in relation to one another.

Figure 2:
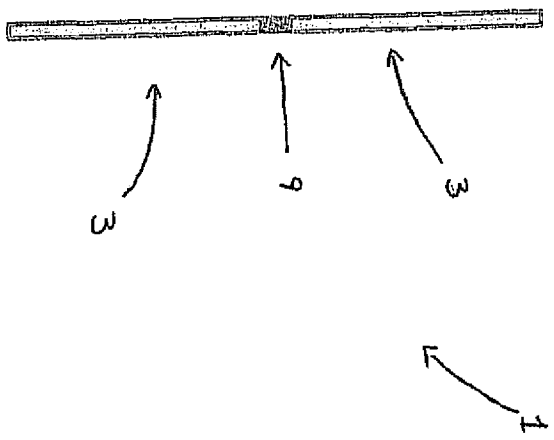
FIG. 2 illustrates a side view of a uniting plate with a connection line.

FIG. 2 illustrates a side view of a uniting plate comprising two flanges 3. In this particular embodiment the flanges 3 are illustrated to be of similar size and connected by a rigid connection line 9. By comparison with the front view of the uniting plate as illustrated in FIG. 1, it is obvious that the plate is a relatively thin plate.

Figure 3:
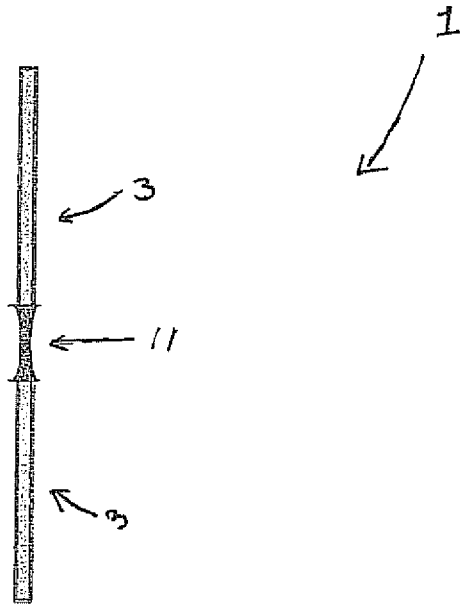
FIG. 3 illustrates a side view of a uniting plate with a flexible connection line.

As an alternative, the flanges 3 of the uniting plates can be combined by connection lines with different properties 11 as illustrated in FIG. 3. FIG. 3 illustrates a side view of a uniting plate 1. In this uniting plate 1, the two flanges 3 are combined by a flexible connection line 11. Combining two uniting plates 1 comprising a flexible connection line 11 enables the uniting plates 1 to be flexed into positions where the angle between the two plates are more or less than 90 degrees.

As a further alternative, the uniting plates 1 can be designed to comprise a flange of minor size 13 along with a major flange 3. This is illustrated in FIG. 4 where the lower flange 3 being of similar size to the flanges 3 observed for uniting plates 1 of FIGS. 1-3 while the upper flange 13 is much smaller and only of minor size.

Figure 4:
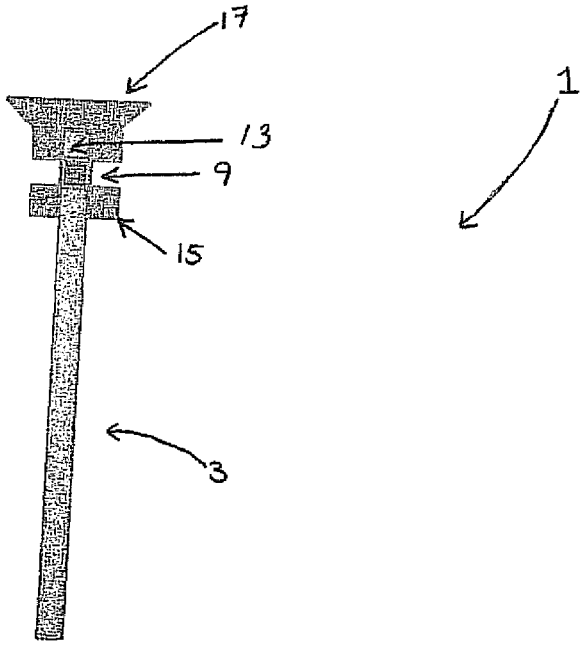
FIG. 4 illustrates a side view of a uniting plate with one minor flange and one major flange.
Figure 5:
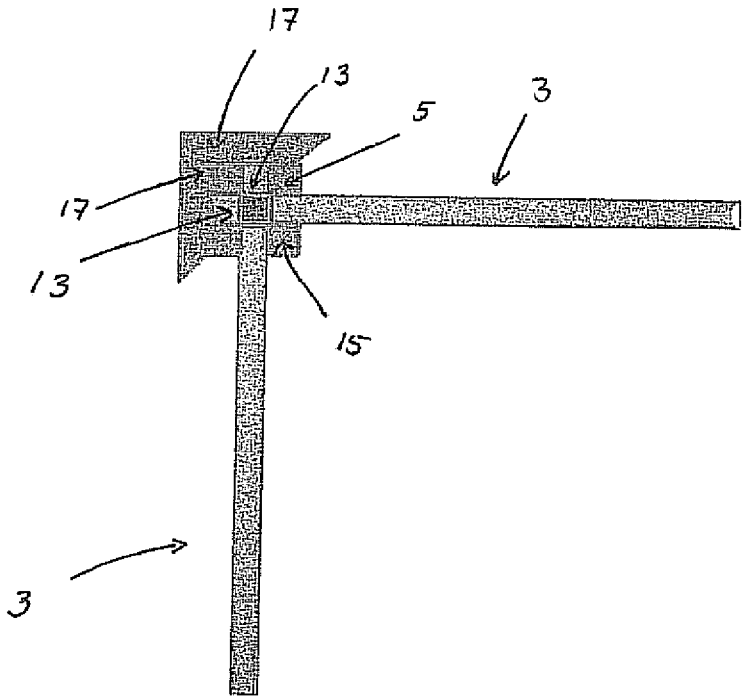
FIG. 5 illustrates a side view of two combined uniting plates with one minor flange, each.

The embodiment of the uniting plate 1 as illustrated in FIG. 4 further illustrates a hat 17 situated around the minor flange 13. In addition, ridges 15 can be situated just below the connection line 9. The advantages of adding a hat 17 to the uniting plate 1 are observed in FIG. 5 where two uniting plates of the type illustrated in FIG. 4 are combined by connecting the slots of the two uniting plates. As observed in FIG. 5, the form and the shape of the hat 17 add up to form a corner with smooth sides. In this way, uniting plates can be combined to form a corner with shielding of the minor flanges 13. Without the hat 17, the small flanges would stick out and disturb the overall appearance of the building elements.

Figure 6:
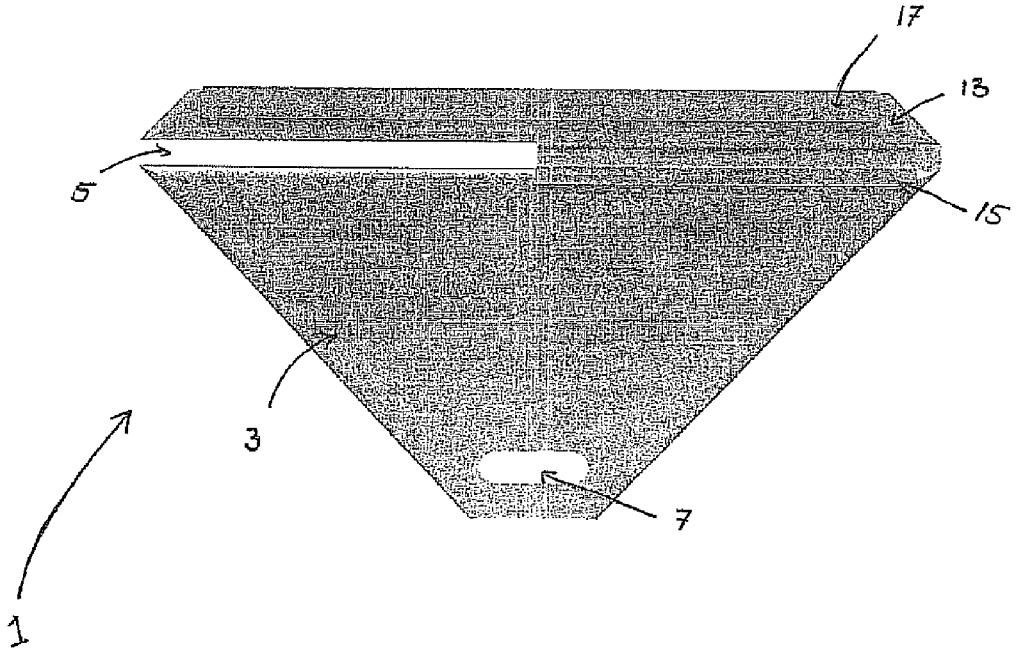
FIG. 6 illustrates a front view of a uniting plate with one minor flange and one major flange.

A front view of a uniting plate 1 is illustrated in FIG. 6 where the uniting plate 1 contains only one flange of major size 3 and a minor flange 13 with a hat 17 on top of it along with ridges 15. Furthermore, the slot 5 for engagement of two uniting plates is observed along with an aperture 7 in the major flange 3.

Figure 7:
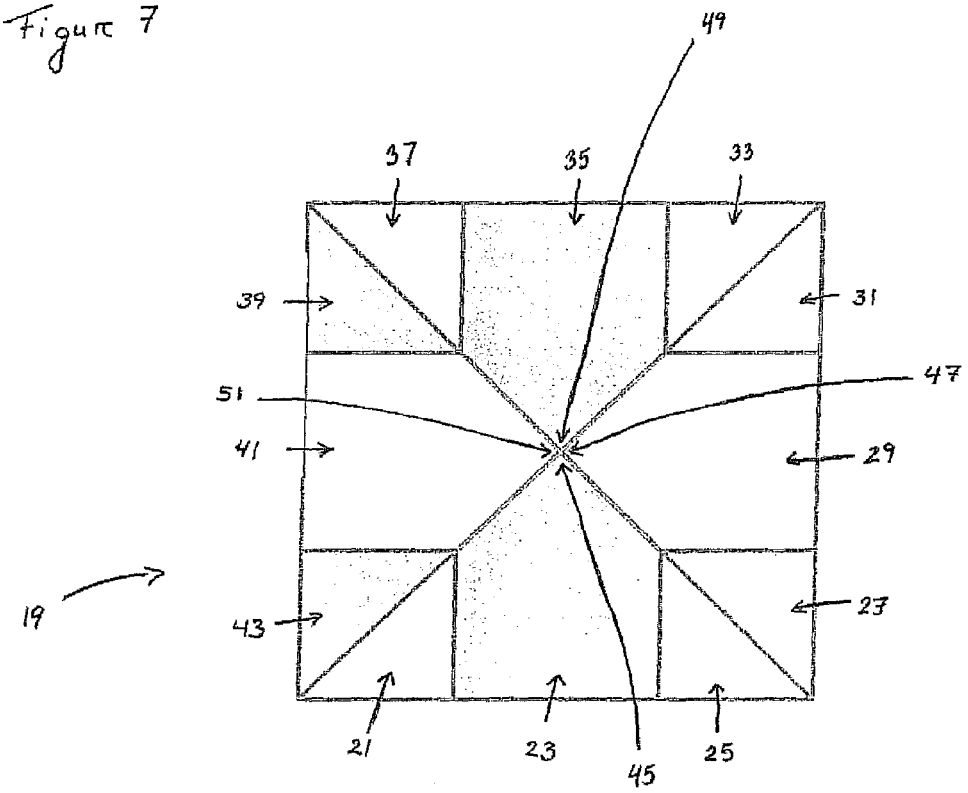
FIG. 7 illustrates a front view of a base plate.

FIG. 7 illustrates a front view of a base plate 19. In this particular embodiment, the base plate comprises four triangularly shaped means for interaction (21, 23, 25; 27, 29, 31; 33, 35, 37; 39, 41, 43) for combining with the flanges 3 of the uniting plate 1. All these triangularly shaped means for interaction are placed with their apex 45, 47, 49, 51 against one another in order to form a square.

Each of the triangularly shaped means for interaction (21, 23, 25; 27, 29, 31; 33, 35, 37; 39, 41, 43) is divided into three parts. The base plate 19 comprises three parallel planes in which the parts of the triangles are situated alternating between the first and the third plane (23, 27, 31, 25, 29, 43 are in the first plane while 21, 25, 29, 33, 37, and 41 are in the third plane). Thus, if the first triangularly shaped means for interaction, the outermost parts are situated in the first plane 27, 31 and the middle part is situated in the third plane 29, then the second triangularly shaped means for interaction next to it has the middle part situated in the first plane 35 while the two outer parts will be in the third plane 33, 37. The parts of the third triangularly shaped means for interaction will then be situated as follows; the outermost parts are situated in the first plane 39, 43 while the middle part is situated in the third plane 41. The parts of the fourth triangularly shaped means for interaction will then be situated as follows; the outermost parts are situated in the third plane 23 while the middle part is situated in the first plane 21, 25. The alternation between the upper and lower planes of the parts of the means for interaction creates an envelope function. This envelope function is designed in order for the uniting plate to slide in between the planes of the base plate. In this way, the base plate 19 and uniting plate 1 can be combined, and they are be able to form structures of different sizes and shapes in a three-dimensional manner.

Figure 8:
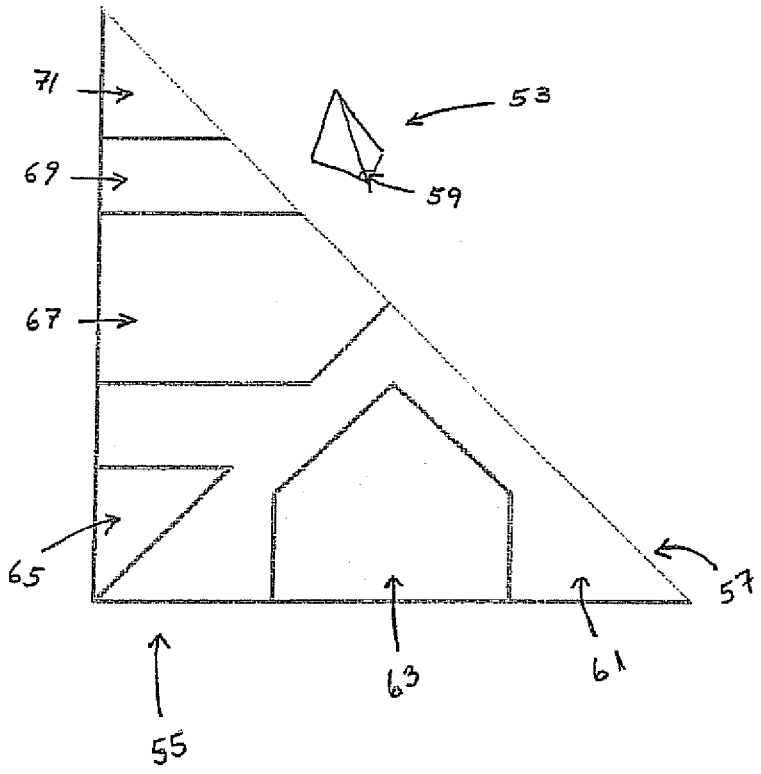
FIG. 8 illustrates a front view of one of the sides of a corner base plate along with a top view of the corner plate.

FIG. 8 illustrates an embodiment in the form of a corner plate 53. The corner plate, in this particular embodiment, comprises two triangularly shaped parts 55 which are united along the hypotenuse 57 of the triangle in a given angle 59. The size of the angle 59 can vary in order to obtain multiple corner plates to be able to build more structures. The corner plate 53 is two joint base plates 19 and thus, comprises parts 61, 63, 65, 67, 69, 71 in a first 61, 69 and a third 63, 65, 67, 71 plane. These parts are alternating between the first and third plane in order to provide an envelope-like function similar to the base plate 19. As an example, the flange of the uniting plate can be situated above the part 63 but below part 61 in order to connect the uniting plate with the corner plate.

Figure 9:
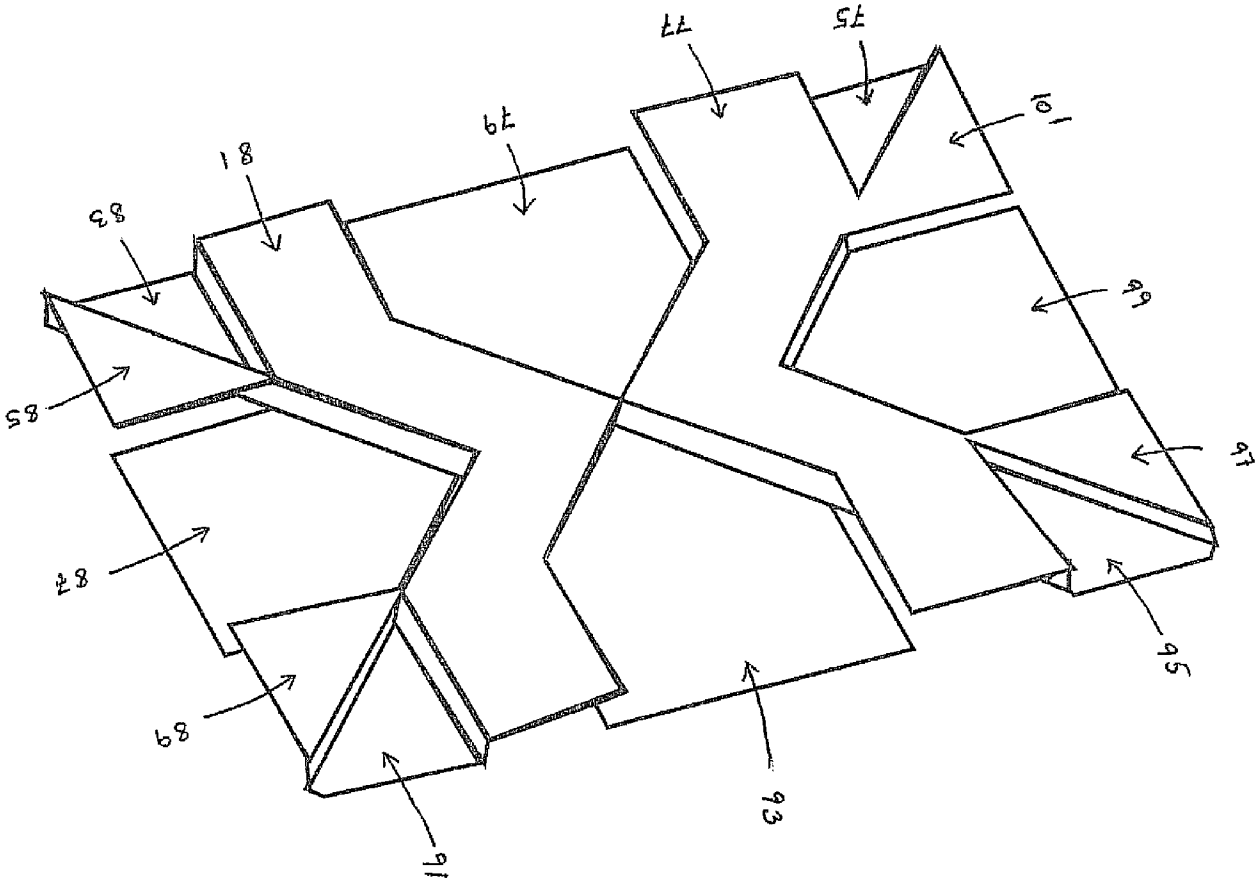
FIG. 9 illustrates a front view of a rectangular base plate.

FIG. 9 illustrates a rectangular base plate 73. The rectangular base plate 73, in this particular embodiment, is divided into multiple parts 75, 77, 79, 81, 83, 85, 87, 89, 91, 93, 95, 97, 99, 101 arranged in a first and third parallel plane in an alternating way. If the first part 75 is in the first plane, the next part 77 in the third plane, the third part 79 in the first plane, the fourth part 81 in the third plane, the fifth part 83 in the first plane, the sixth part 85 in the third plane, the seventh part 87 in the first plane, the eight part 89 in the third plane, the ninth part 91 in the first plane, the tenth part 93 in the first plane, the eleventh part 95 in the first plane, the twelfth part 97 in the third plane, the thirteenth part 99 in the first plane, and the fourteenth part 101 in the third plane. In this particular embodiment, four different envelopes are created by the alternating parts 85,87,89; 97,99,101; 77, 79, 81; 81, 93, 77. In addition, connections between the first plane and third plane are observed 78. These connections help to control the insertion of the flange 3 of the uniting plate 1.

Figure 10:
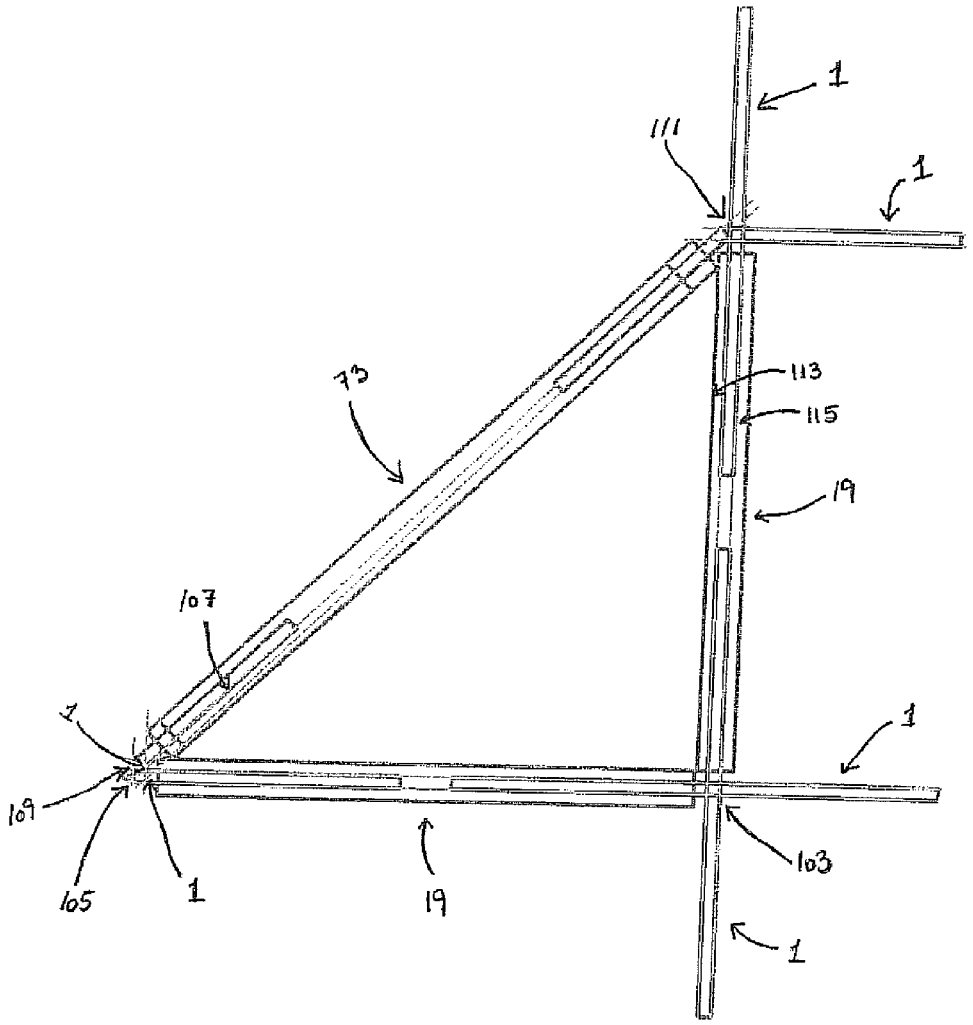
FIG. 10 illustrates a side view of a rectangular base plate combined with two base plates together with several uniting plates.

The use of a rectangular base plate 73 is illustrated in FIG. 10. This embodiment illustrates a rectangular base plate 73 connected to two base plates 19 formed as squares via uniting plates 1. In the lower right corner 103 the uniting plates 1 are combined at an angle of 90 degrees. In the lower left corner 105 the uniting plates 1 are combined in an angle different from 90 degrees and thus, the uniting plates 1 comprises a flexible connection line as described in FIG. 3. Furthermore, the uniting plates 1 of the lower left corner 105 are uniting plates 1 of the type described in FIG. 4 where the uniting plate 1 comprises one major flange 107 and one minor flange 109. The uniting plates 1 of the upper right corner 111 are combined in an angle different from 90 degrees, and thus, the uniting plates 1 comprises a flexible connection line as described in FIG. 3. The advantage of the rectangular base plate is illustrated in this embodiment since the rectangular base plates are able to form sloping lines. The sloping lines can be useful for more alternatives like for example creating roofs of houses.

FIG. 10 furthermore illustrates a side view of the envelope function. The uniting plates 1 are observed to be arranged between the two parallel planes 113, 115 of the base plates 19 and the rectangular base plate 73.

Figure 11:
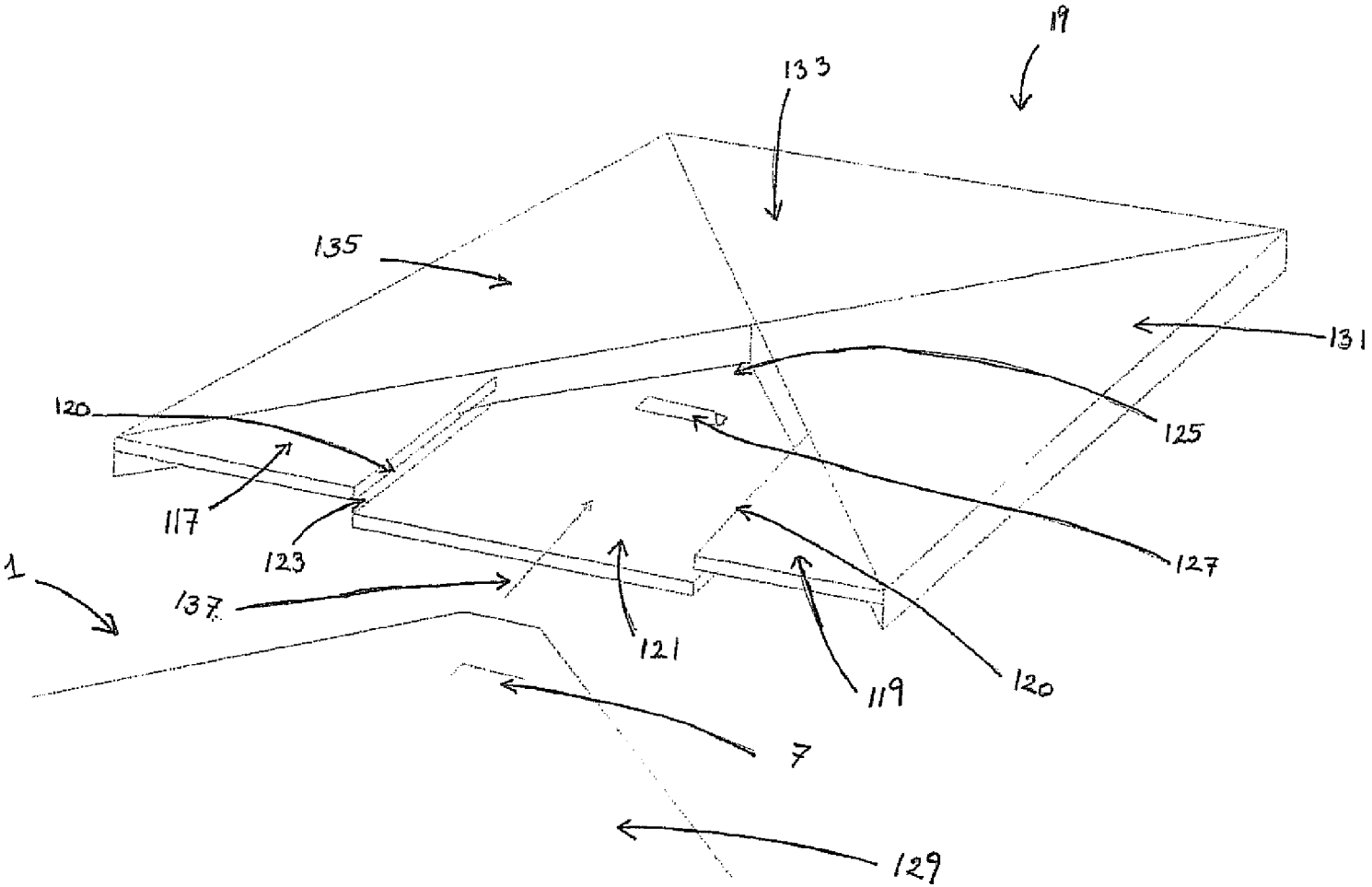
FIG. 11 illustrates a vertical envelope function of a base plate.

A front view of the envelope function created by the three planes of the base plate 19 is illustrated in FIG. 11. The first plane 117, 119 and the third plane 121, of the base plate is observed on either side of the second plane 123. In this case, the outermost parts 117, 119 of the triangularly shaped means of interaction 117, 119, 121 are in the first plane while the middle part 121 is in the third plane. It is to be understood that the first and third planes are interchangeable.

Furthermore, the middle part 121 contains a ridge 127 close to apex 125 of the middle part 121 of the base plate 19. The ridge 127 interacts with the aperture 7 of the flange 129 of the uniting plate 1 when the flange 129 is arranged in the base plate 19. Thus, the ridge 127 can be arranged at an arbitrary position at the means of interaction 117, 119, 121 as long as it fits with the position of the aperture 7. For the purpose of illustration, no other means of interaction 117, 119, 121 are illustrated in the other three triangles 131, 133, 135 observed in the base plate 19. It is to be understood that the base plate 19 when formed as a square and containing triangularly formed means of interaction as here illustrated may contain any number between and including one to four means of interaction.

An increased stability of the connection between the uniting plate 1 and the base plate 19 is obtained by the releasable interaction of the ridge 127 and the aperture 7 of the flange 129 the uniting plate 1 is. The shape of the ridge 127 is in FIG. 1 illustrated with a decreasing height in the direction of the arrow 137, which illustrates the movement of the uniting plate 1 when slid into the second plane 123 of base plate 19. The size of the ridge 127 is as big as to increase the connection stability between the base plate 19 and the uniting plate 1 but no bigger than the flange 129 of the uniting plate 1 is easily released by pulling it.

Figure 12:
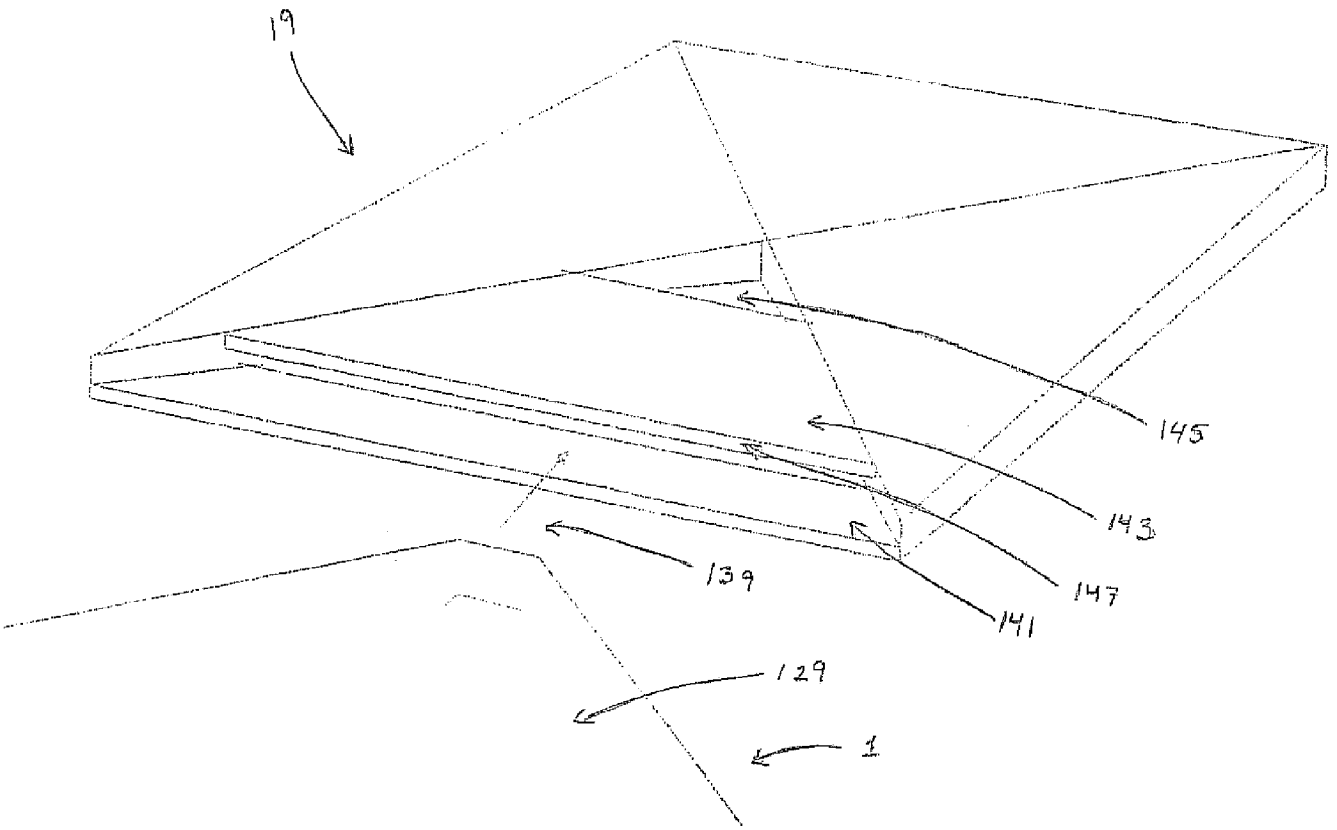
FIG. 12 illustrates a horizontal envelope function of a base plate.

FIG. 12 illustrates another embodiment of the envelope function, a horizontal alternative compared to the envelope function of FIG. 11 where the envelope function is a vertical alternative. In the embodiment as illustrated in FIG. 12, the uniting plate 1 is introduced into the second plane of the base plate 19 following the direction of the arrow 139. The parts of the means of interaction 141, 143, 145 of the base plate 19 are in this context divided by lines 147 perpendicular to the direction of the arrow 139. This is compared to the parts of the means of interaction 17, 119, 121 of the base plate 19 illustrated in FIG. 11 where the lines 120 of division are parallel to the direction of the arrow.

Figure 13:
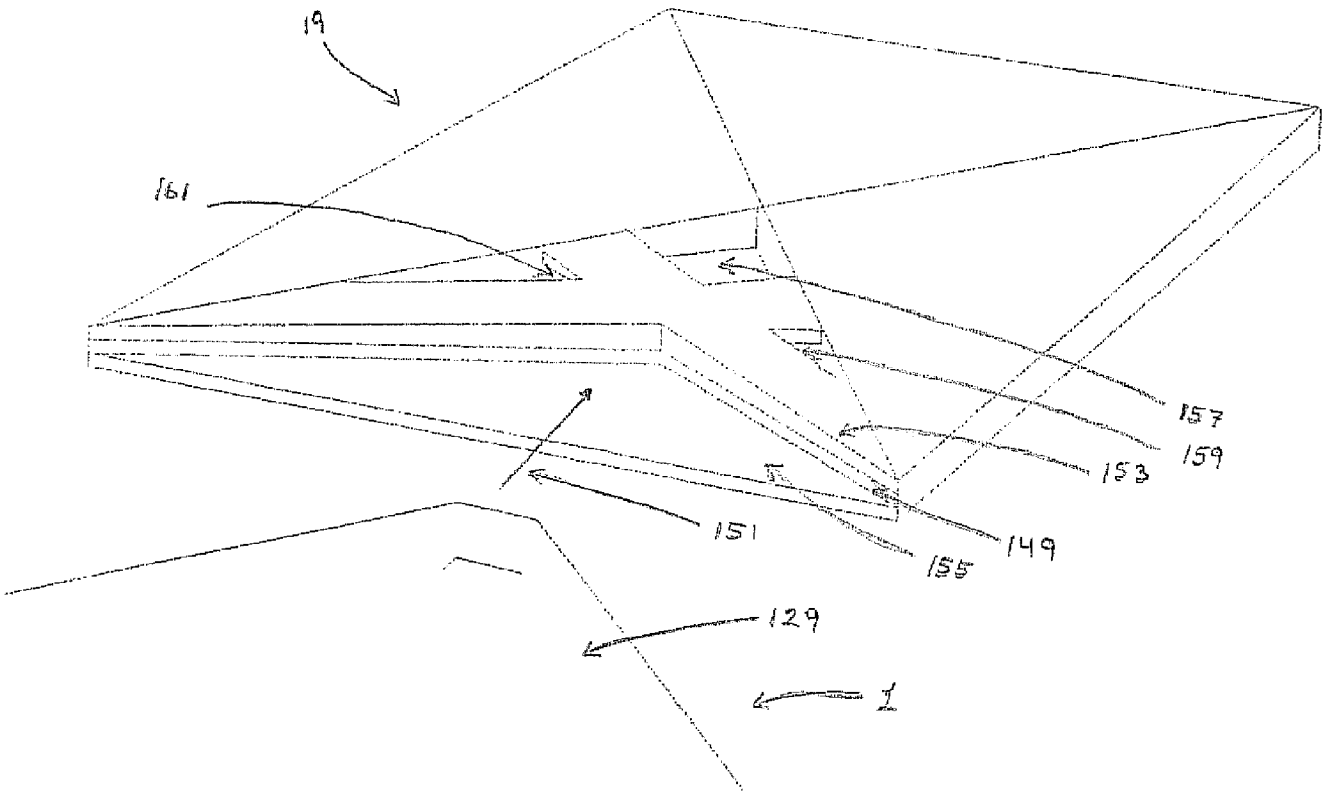
FIG. 13 illustrates a diagonal envelope function of a base plate.

FIG. 13 illustrates a further embodiment of the envelope function, a diagonal alternative. In this embodiment, the flange 129 of the uniting plate 1 is introduced into the second plane 149 of the base plate 19 in the direction of the arrow 151. The parts of the means of interaction 155, 157, 159, 161 of the base plate 19 are divided by lines neither parallel nor perpendicular to the direction of the arrow but in any given angle between parallel and perpendicular.

Figure 14:
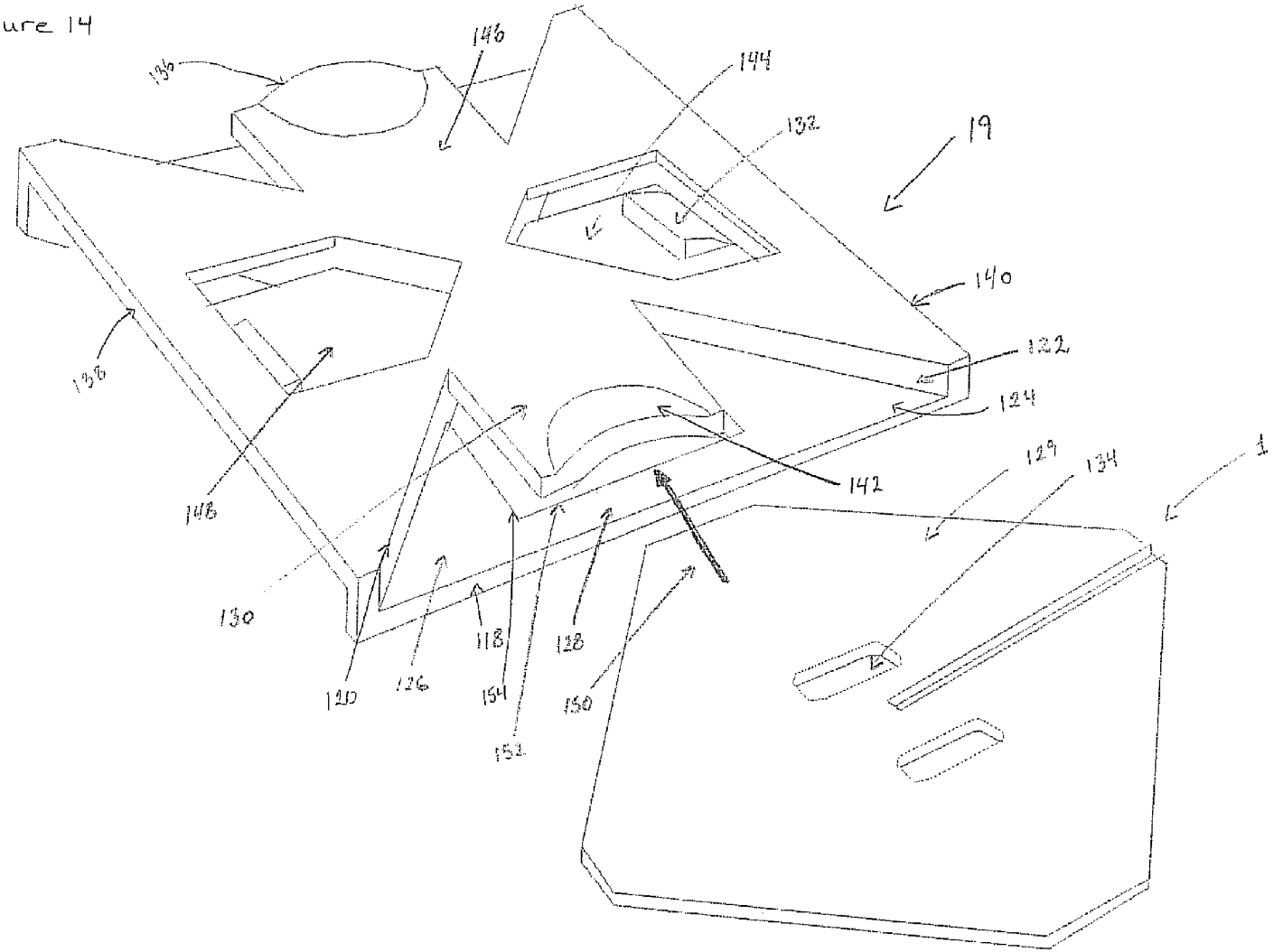
FIG. 14 illustrates a vertical-horizontal envelope function of a base plate.

FIG. 14 illustrates a vertical-horizontal envelope function of a base plate. A front view of the envelope function created by the three planes of the base plate 19 is illustrated in FIG. 14. The first plane 118 and the third plane 120, of the base plate is observed on either side of the second plane 122. It is to be understood that the first and third planes are interchangeable.

The first plane 118 comprises two triangularly shaped parts 124, 126 of the means for interaction connected with a stabilising bridge 128. The third plane 120 comprises a short middle part 130. In this particular embodiment, the short middle part 130 comprises a ridge 132. The ridge 132 interacts with the aperture 134 of the flange 129 of the uniting plate 1 when the flange 129 is arranged in the base plate 19. For the purpose of illustration, only the means of interaction 124, 126, 128, 130 in one out of four parts are illustrated. It is to be understood that the base plate 19 when formed as a square and containing triangularly formed means of interaction as here illustrated may contain any number between and including one to four means of interaction.

In this particular embodiment, four triangularly shaped means of interaction 124, 126, 128, 130; 136; 138; 140 are illustrated. The parts of each means of interaction are similarly shaped though the middle part of two means of interaction 124, 126, 128, 130; 136 are in the third plane 120, while the middle part of the two other means of interaction 138, 140 are in the first plane 124 i.e. they are rotated 180 degrees to one another.

An increased stability of the connection between the uniting plate 1 and the base plate 19 is obtained by the releasable interaction of the ridge 132 and the aperture 134 of the flange 129. The size of the ridge 132 is as big as to increase the connection stability between the base plate 19 and the uniting plate 1 but no bigger than the flange 129 of the uniting plate 1 is easily released. It is to be understood that similar ridges are arranged beneath the middle parts 130, 144, 146, 148 of each means of interaction 124, 126, 128, 130; 136; 138; 140. However, the ridges are only visible for two of the means of interaction 138, 140 of the illustration.

In this particular embodiment, the middle part 130 comprises a raised front part 142. The raised front part 142 is elevated in a manner that enables one or more fingers to be arranged underneath i.e. between the means of interaction 130 in the third plane 120 and the uniting plate 1 when this engages with the base plate 19. Hereby, the middle part 130 can easily be slightly elevated and the ridge 132 is removed from the aperture 7. This unlocking procedure can also be performed by pushing at the ridge 132 whereby the ridge 132 is pushed out of the aperture 7 and the uniting plate 1 can be removed.

In the embodiment, the uniting plate 1 is introduced into the second plane 122 of the base plate 19 following the direction of the arrow 150. The parts of the means of interaction 124, 126, 128, 130 of the base plate 19 are in this context divided by lines 152 perpendicular to the direction of the arrow 139 and lines 154 parallel to the direction of the arrow 139.

Figure 14A:
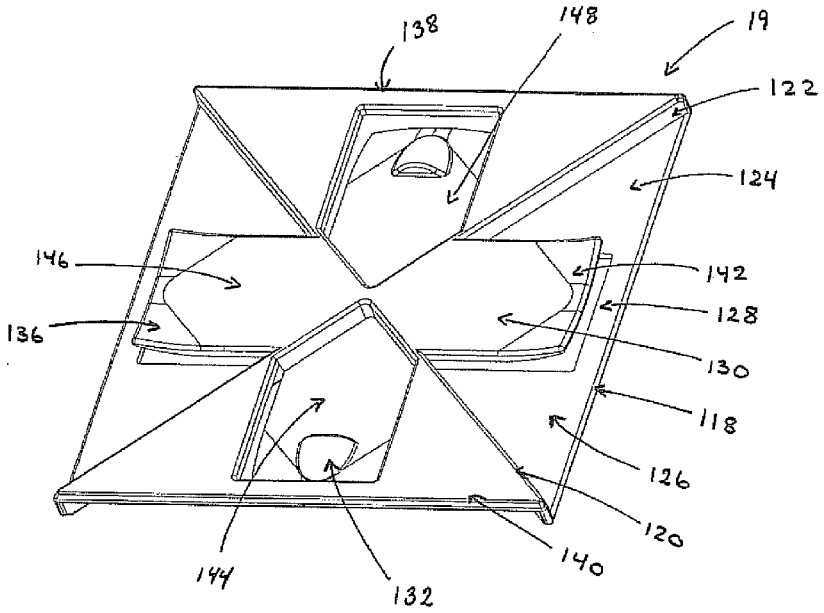
FIG. 14A illustrates an alternative embodiment of a vertical-horizontal envelope function of a base plate.

FIG. 14A illustrates an alternative embodiment of the base plate as illustrated in figure 14. The difference between the embodiments are the design of the raised front part 142, where the elevation in FIG. 14A is more at the edges than in the middle of the middle part 130.

Figure 15:
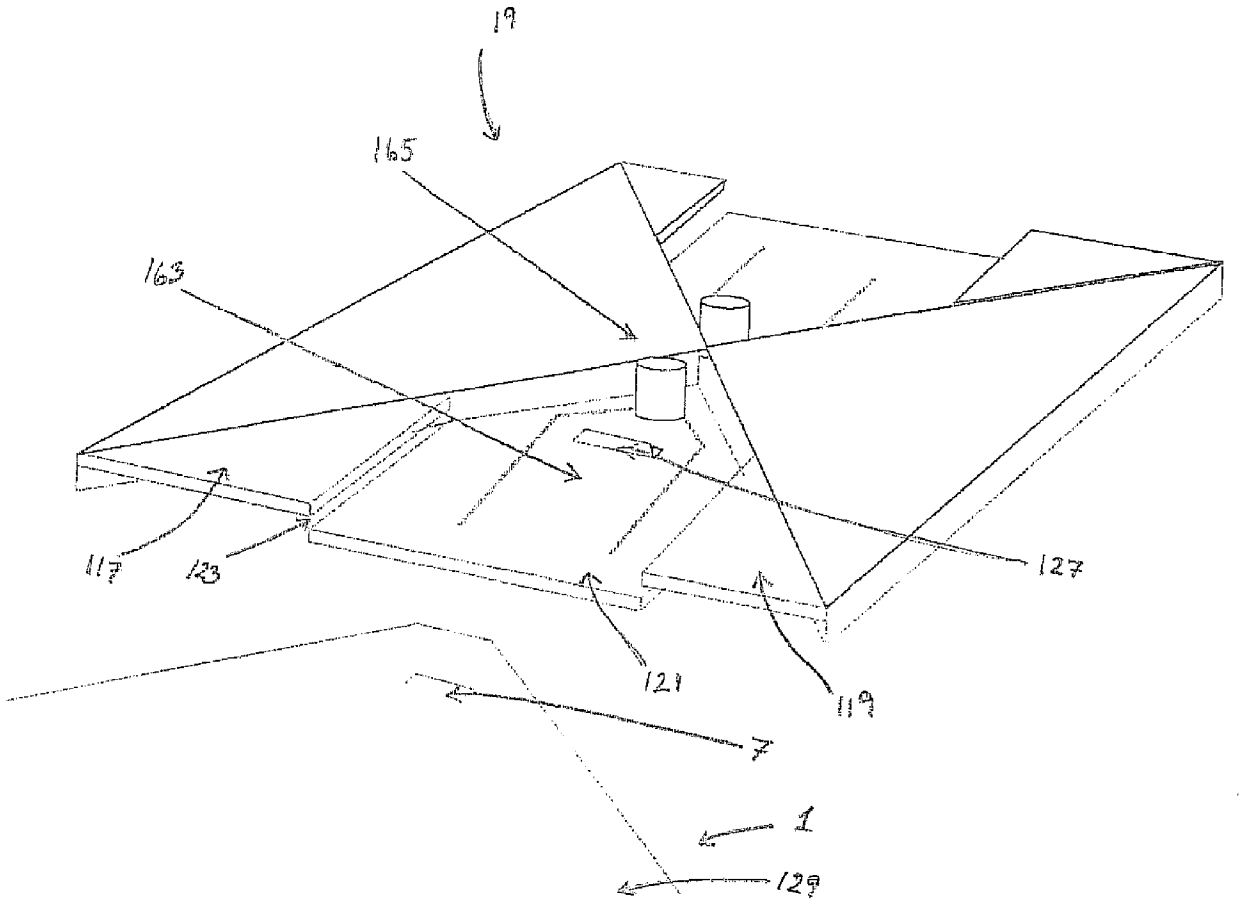
FIG. 15 illustrates the locking mechanism between a uniting plate and a base plate.

FIG. 15 illustrates an alternative embodiment of the locking mechanism as illustrated in FIG. 11. In this embodiment, the means of interaction 117, 119, 121 are divided into two outermost parts 117, 119 in the first plane and a middle part 121 in the third plane. The middle part 121 further comprises a ridge 127 for engagement with the aperture 7 of the uniting plate 1. In this particular embodiment the ridge 127 is situated in a resilient member 163 and furthermore release means 165 are present. In FIG. 14 the release means are in the form of a dot.

During combination of the uniting plate 1 and the base plate 19 the flange 129 of the uniting plate 1 is slid into the second plane 123 of the means of interaction 117, 119, 121 of the base plate 19. Hereby, the resilient member 163 is slightly urged down until the ridge 127 reaches the aperture 7. Then the flange 129 of the uniting plate 1 is retained in connection with the means of interaction 117, 119, 121 of base plate 19. Furthermore, the flange 129 of the uniting plate 1 is pressed against the outermost parts 117, 119 due to the elevation of the resilient layer 163.

To release the flange 129 of the uniting plate 1 from the means of interaction 117, 119, 121 of the base plate 19, the release dot 165 is urged down and the uniting plate 1 pulled away from the base plate 19. Hereby, the ridge 127 is removed from the aperture 7 and the locking mechanism released.

Figure 16:
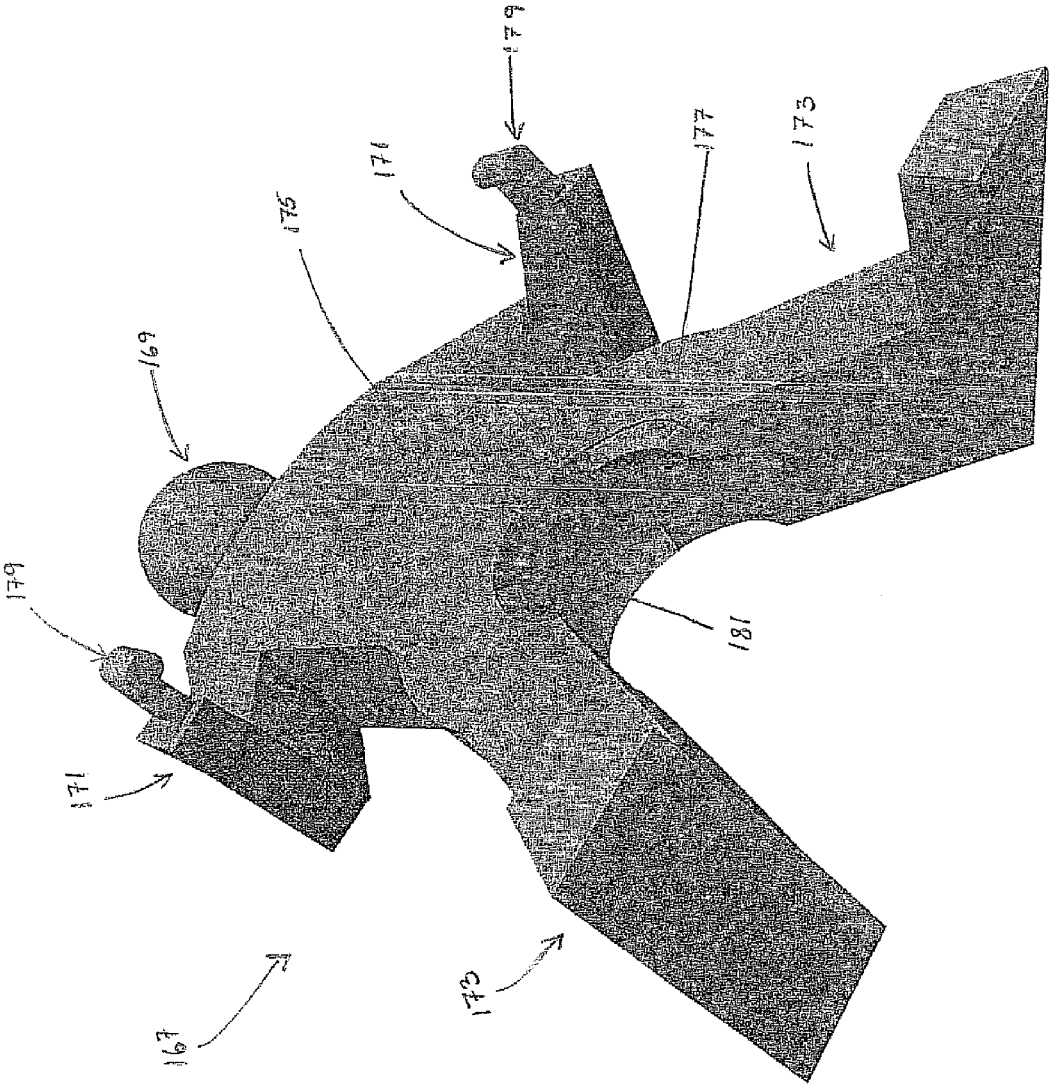
FIG. 16 illustrates a first play figure.

FIG. 16 illustrates a first play figure 167. This first play figure 167 comprises a head 169, two arms 171, two legs 173, a torso 175, and a space complementary to the shape of the head 177. Furthermore, the first play figure 167 comprises two hands with a shape that enables them to interact with the aperture 7 of the flange 3 of the uniting plate 1 and hold the uniting plate 1 in a retained position.

Figure 17:
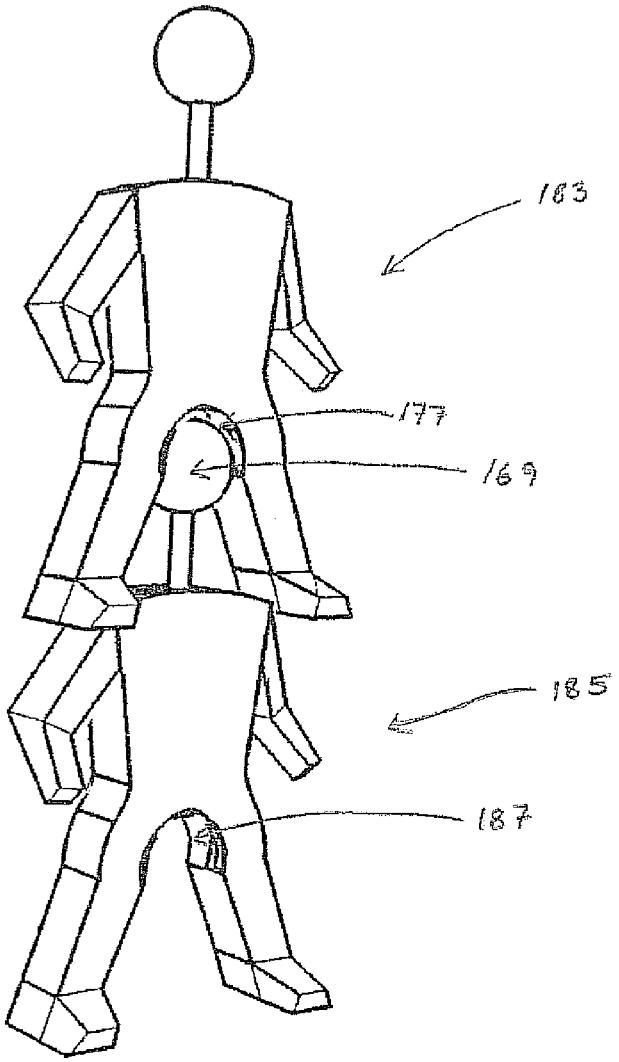
FIG. 17 illustrates a combination of two first play figures.

The space complementary to the shape of the head 177 may be provided with ridges 181 in order for the space to retain the head 169 in position. The head 169 to be arranged in the space 177 is the head of another first play figure as illustrated in FIG. 17. FIG. 17 illustrates how the space complementary to the shape of the head 177 of the first first play figure 183 interacts with the head 169 of the second first play figure 185. Likewise, the head of a third first play figure can be engaged with the space complementary to the shape of the head 187 of the second first play figure and so forth in order to create a long row of interconnected figures.

Figure 18:
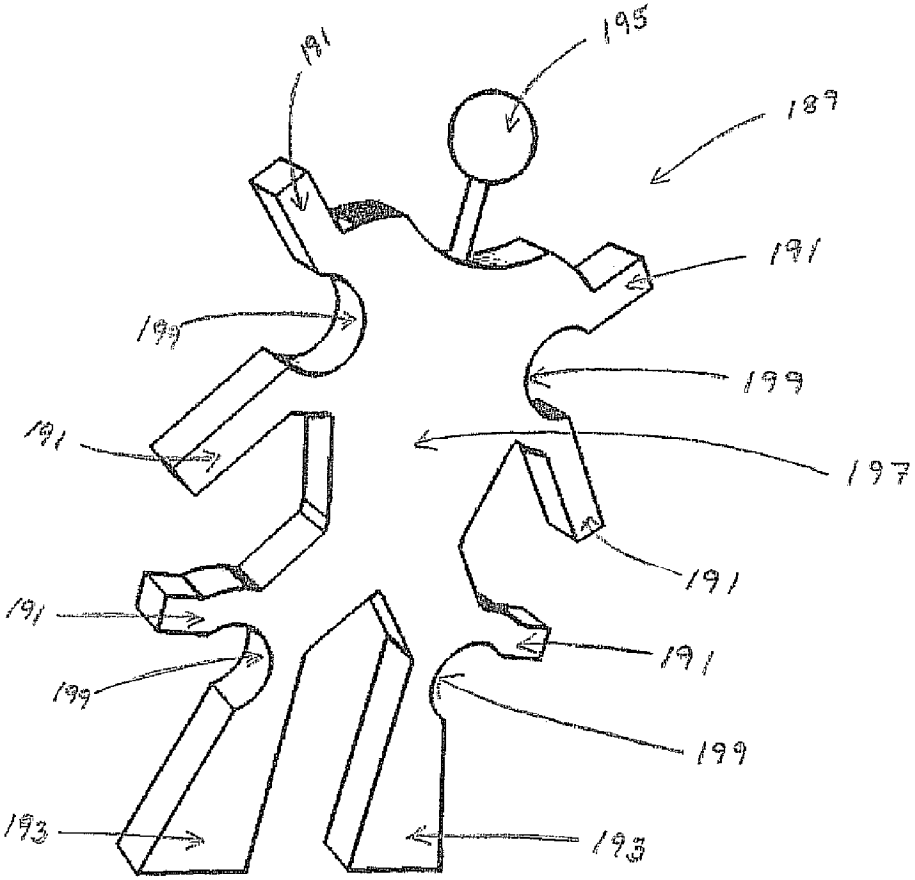
FIG. 18 illustrates a second play figure.

FIG. 18 illustrates a second play figure 189. This particular second play figure 189 comprises six arms 191, two legs 193, a head 195, a torso 197 and four spaces complementary to the shape of the head 199. Preferably, the size of the spaces complementary to the shape of the head 199 is similar in size to the spaces complementary to the shape of the head 177 present on the first play figure and the heads of the first play figure 169 and of the second play figure 195 are similar in size. Thus, the first and second play figure can be combined in several possible ways.

Figure 19:
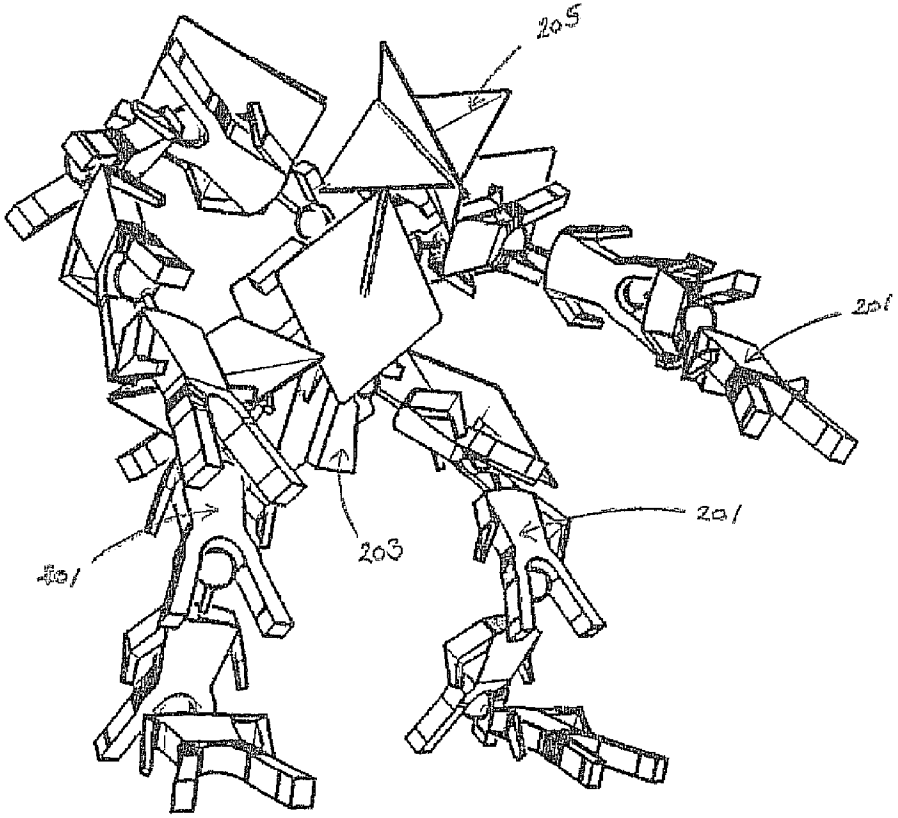
FIG. 19 illustrates a combination of a second play figure with multiple first play figures and uniting plates.

FIG. 19 illustrates the combination of several first play figures 201 with a second play figure 203 and multiple uniting plates 205. By combining the first play figure, the second play figure, and different types of uniting plates new three-dimensional figures can be created.

Figure 20:
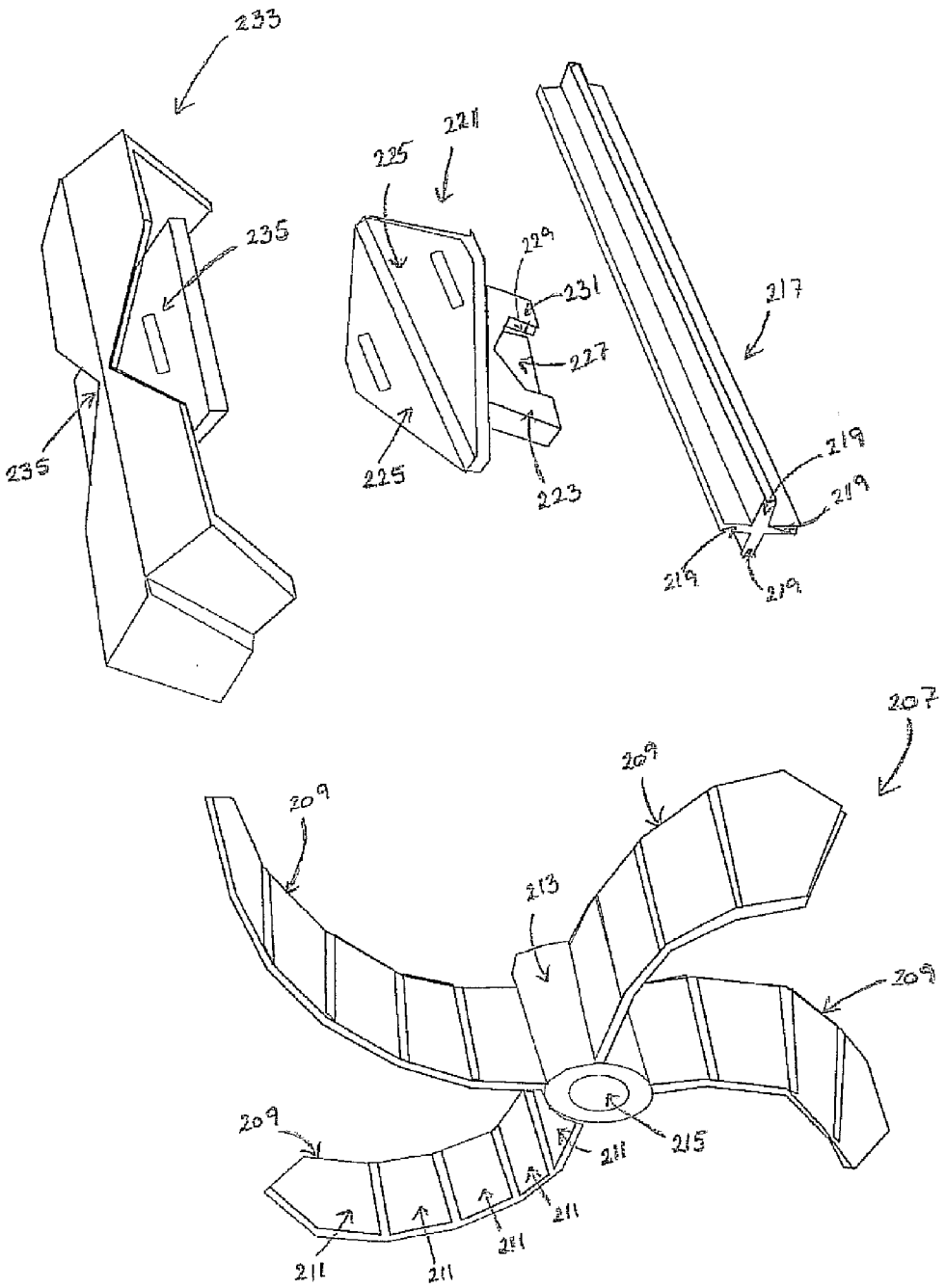
FIG. 20 illustrates elements that can be combined to form wheels.

FIG. 20 illustrates the embodiment of the base plate and uniting plate along with the supplementary parts to enable the formation of wheels. The wheel comprises an inner part 207 illustrated to comprise four flanges 209 each divided into multiple sub-elements 211. The number of flanges is, however, not limited to four as well as the division into sub-elements not is mandatory. The flanges of the inner part 207 are arranged on a circular hub 213, which comprises a central aperture 215.

The central aperture 215 can be combined with an axis 217 through the central aperture 215. In this way, multiple wheels can be connected. The axis 217 is shaped as a cross comprising four flanges 219. These four flanges 219 can engage with a complementary shape inside the central aperture 215.

The flanges of the inner part 207 can be engaged with a special embodiment of a uniting plate 221. This embodiment comprises a third flange 223 perpendicular to the two flanges 225 of the single plane. The third flange comprises an envelope structure with a first plane 227, a second plane 229, and a third plane 231, where the flange of the inner part 207 engages with the uniting plate 221 through the second plane 229.

After attaching the uniting plate 221 to the inner part 207 of the wheel, the two flanges 225 can be combined with base plates 233 to form the surface of the wheel. In this particular embodiment the base plate comprises a rectangular shape with two means of interaction 235 arranged on the longer side of the rectangle. Multiple base plates 233 can be combined by uniting plates with 221 or without 1 a third flange 223.

Figure 21:
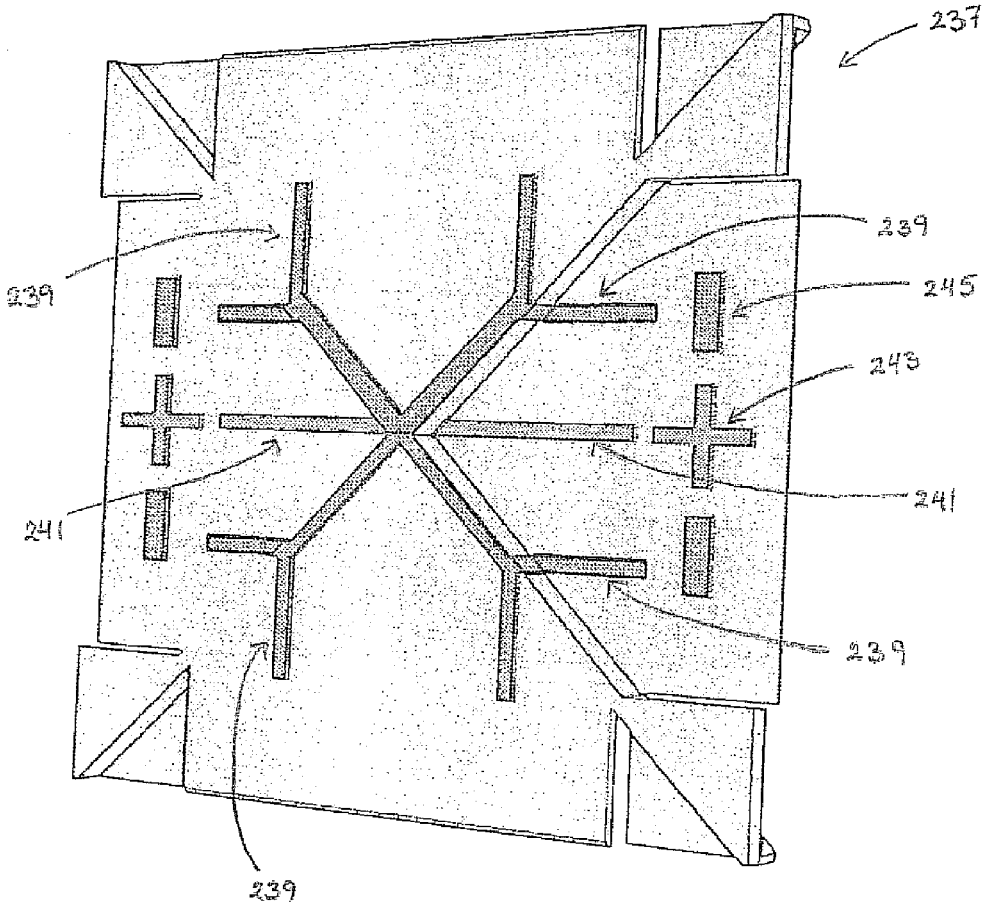
FIG. 21 illustrates a base plate comprising electronic conductors.

FIG. 21 illustrates a base plate 237 comprising electronic conductors 239, 241 to be able to transmit an electrical signal. The electronic conductors are represented at least by a first anode 241 and a first cathode 239. In this particular embodiment, the cathodes 241 are shown as two straight lines and defined by a plus 243, and the anodes 239 are shown as four branched lines and defined by a minus 245.

In this particular embodiment, the electronic conductors are arranged on either side of the base plate 237. The electronic conductors can, however, be arranged on one of the sides, only.

Figure 22:
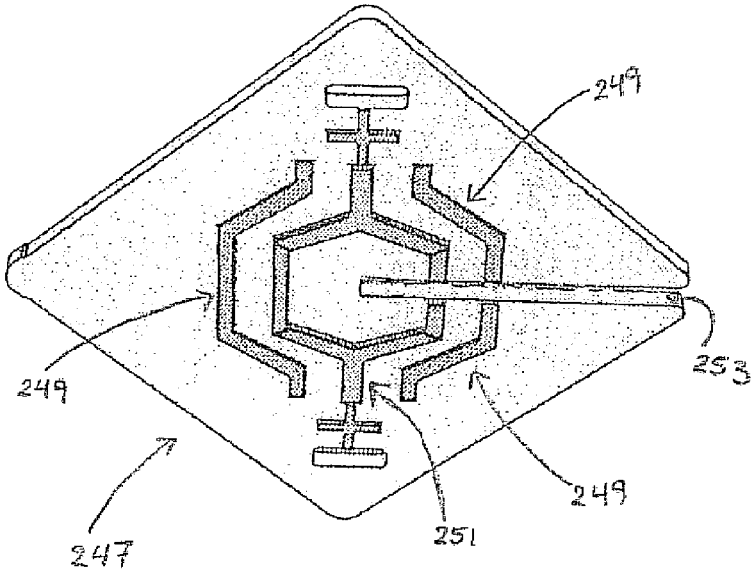
FIG. 22 illustrates a uniting plate comprising electronic conductors.

FIG. 22 illustrates a uniting plate 247 comprising electronic conductors 249, 251. The electronic conductors are represented by a second anode 249 and a second cathode 251. The second anode 249 is formed by two paths, while the second cathode 251 is comprised of a semi-circular path. The second cathode 251 and one of the second anodes 249 is disintegrated by the slot 253 of the uniting plate 247.

In this particular embodiment, the electronic conductors are arranged on either side of the uniting plate 247. The electronic conductors can, however, be arranged on one of the sides, only.

Figure 23:
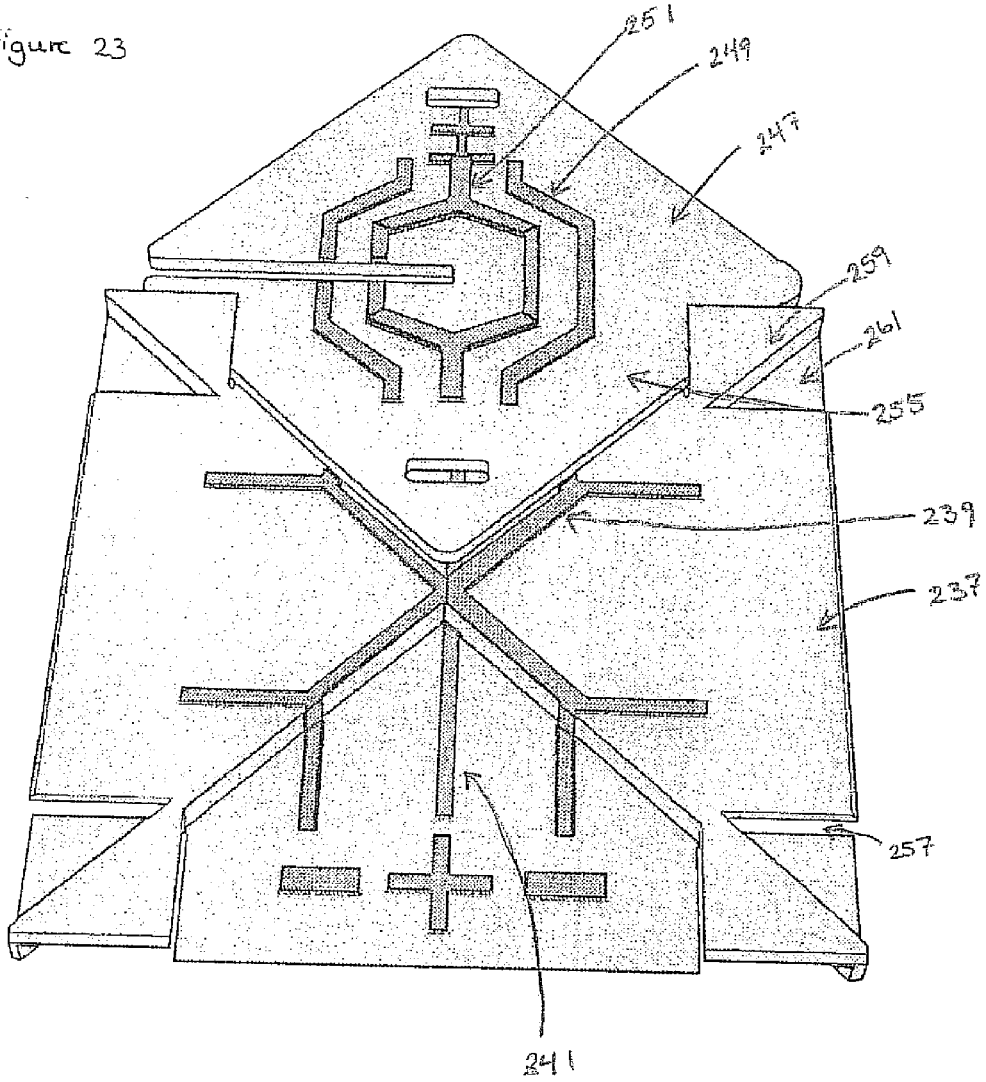
FIG. 23 illustrates the coupling of electronic conductors on a base plate and a uniting plate.

FIG. 23 illustrates the combination of a uniting plate 247 and a base plate 237 both comprising electronic conductors 239, 241, 249, 251. A flange 255 of the uniting plate 247 is arranged in the second plane 257 of the base plate 237 between the first 259 and third plane 261.

Sliding the uniting plate 247 into the second plane 257 of the base plate 237 establish a connection between the first anodes 239 and the second anodes 249 as well as a contact between the first cathode 241 and the second cathode 251 is established. Hereby, an electrical signal can be transferred from the base plate 237 to the uniting plate 247 and vice versa.

It is essential that the electronic conductors are designed properly in order to secure a strong and efficient electronic signal. Thus, the particular shapes of the first cathode 241, second cathode 251, first anodes 239, and second anodes 249. In addition, a steady interaction between the uniting plate 247 and base plate 237 is essential in order to prevent the electronic conductors from sliding in relation to one another and hereby disturb the transferred electronic signal. If high speed data has to be transmitted by the conductors it is preferred that the conductors are shielded from radiated electronic noise generated by radio transmitters. It can also be important that there exists defined electric impedance between the conductors and a ground line.

Figure 24:
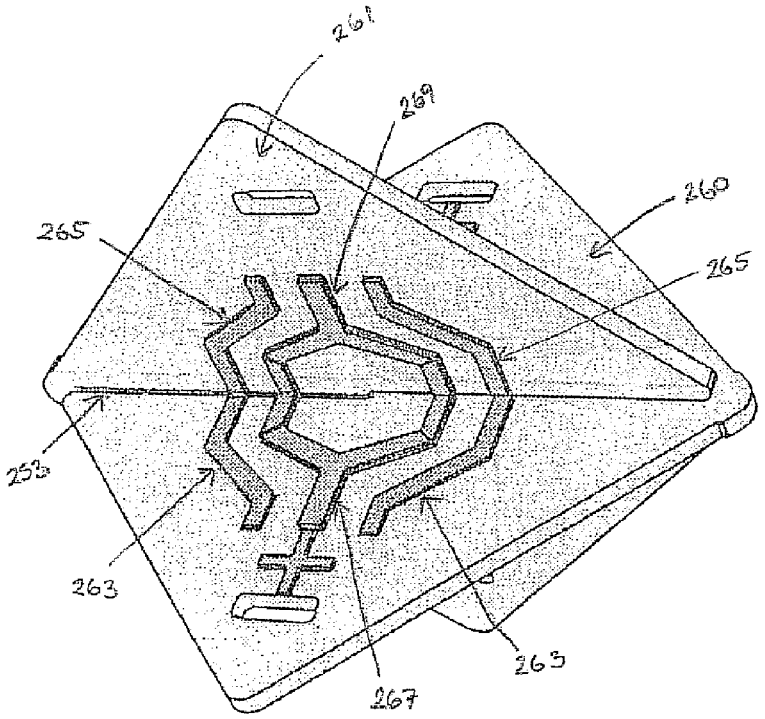
FIG. 24 illustrates the coupling of electronic conductors when combining two uniting plates.

FIG. 24 illustrates how an electrical signal can be transferred in a three-dimensional structure as well as a two-dimensional structure as illustrated in FIG. 22. In FIG. 23 is illustrated integration of two uniting plates—a first uniting plate 260 and a second uniting plate 261—through the slot 253 of each uniting plate 260, 261. This interaction connects the first parts of the second anode 263 on the first uniting plate 260 with the second parts of the second anode 265 on the second uniting plate 261 and connects the first part of the second cathode 267 on the first uniting plate 260 with the second part of the second cathode 269 on the second uniting plate 261. Through this connection contact between the electronic conductors on the first uniting plate 260 and the second uniting plate 261 is established, whereby electrical signal can be transferred from two-dimensions into three-dimensions.

Figure 25:
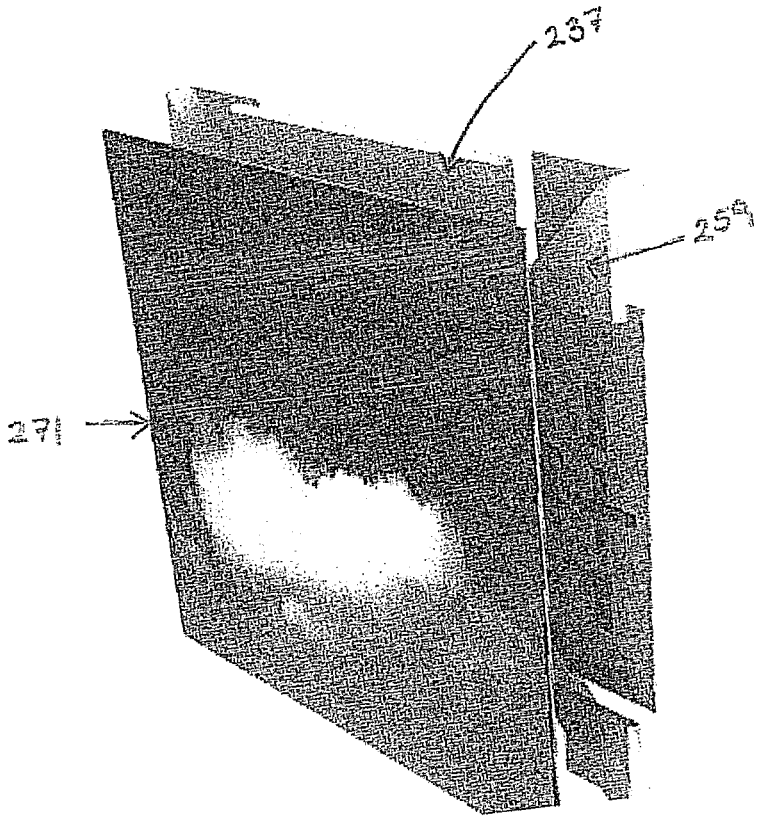
FIG. 25 illustrates a base plate comprising electronic conductors combined with a front plate.

FIG. 25 illustrates how an electric signal can be transferred from a base plate 237 to a front plate 271. The front plate is mounted onto the base plate 237 in a plane substantially parallel with the first plane 259 of the base plate 237. By mounting of the front plate 271 to the base plate 237 electronic conductors of the front plate 271 interacts with the electronic conductors 239, 241 of the base plate 237, whereby an electric signal can be transferred from the base plate 237 to the front plate 271. The front plate 271 is preferably a organic light emitting diode (OLED) or a smartINK surface, whereby the front plate 271 can be used as a display for illustrating for example pictures, in this particular embodiment a cloud.

Figure 26:
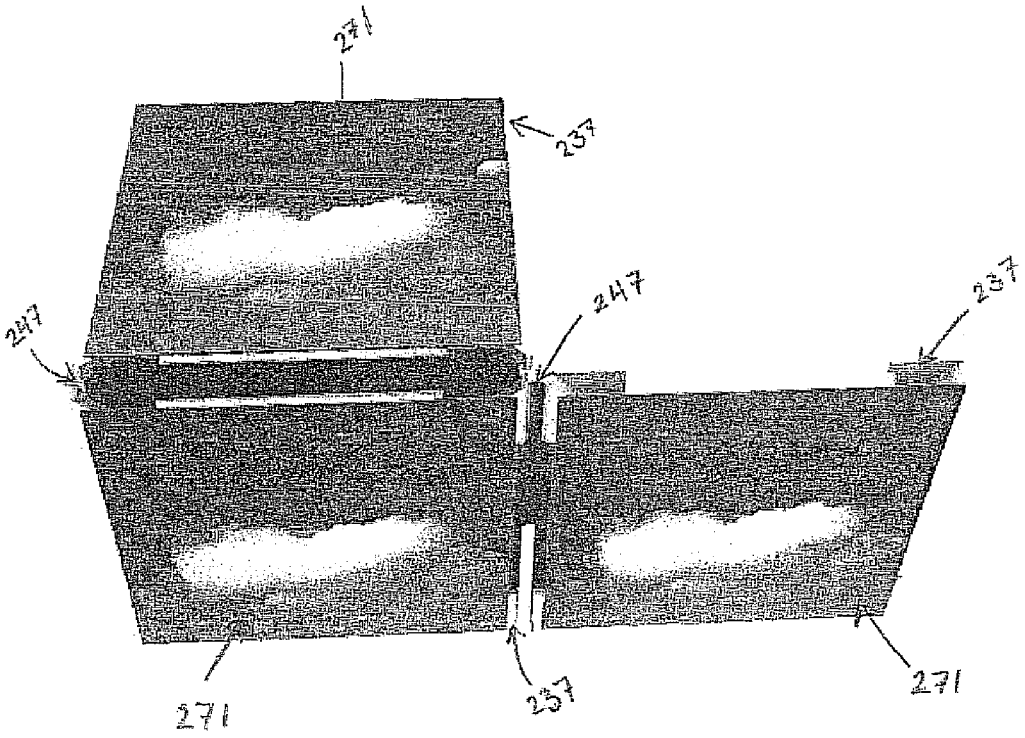
FIG. 26 illustrates three base plates comprising electronic conductors combined with front plates and combined with uniting plates comprising electronic conductors.

Coupling multiple base plates 237 comprising front plates 271 and uniting plates 247 into two- and three-dimensional structures enables illustrations to be shown on multiple front plates 271 as illustrated in FIG. 26. The illustration can be either an identical picture or differing pictures. By different pictures an electronic puzzle can be created or multiple screens for a computer game can be created.

At least one of the base plates 237 or front plates 271 has to be coupled with an electrical power source. This can be a battery, through an external unit such as a computer unit or by connection to the electrical grid.

The invention claimed is:

1. A method of combining building elements, comprising:

combining a uniting plate (1) and a base plate (19), wherein:

a uniting plate (1) comprises at least two flanges (3) defined in a single plane, said at least two flanges (3) being connected by a first connection line (9), said first connection line comprising at least one opening (6) and a slot (5), said slot (5) comprising at least one elevation (8) adapted to engage with an opening on a similar uniting plate to obtain connected uniting plates with their respective flanges in different planes; and a base plate (19), said base plate (19) being substantially planar and having three parallel planes, where the first (117, 119) and third planes (121) are arranged on either side of the second plane (123), where said second plane (123) substantially comprises connection members connecting the first and third plane, whereby a space is obtained between the first and third plane for inserting the flange of the uniting plate, and said base plate (19) comprising at least one means for interaction with one of said at least two flanges (3) of the uniting plate (1), said means for interaction comprising at least two parts, where the at least two parts are in the first and third plane (117, 119, 121), respectively, such that one of the at least two flanges (3) of the uniting plate is adapted to be placed in the second plane (123).

2. The method according to claim 1, wherein said uniting plate (1) comprises at least one first electronic conductor (249) and said base plate comprises at least one second electronic conductor (239), where said at least one first electronic conductor and said at least one second electronic conductor engage during combination of said uniting plate and said base plate, whereby an electrical signal can be transferred from one plate to another.

3. A set of building elements comprising:

a uniting plate (1), said uniting plate (1) comprising at least two flanges (3) defined in a single plane, said at least two flanges (3) being connected by a first connection line (9), said first connection line comprising at least one opening (6) and a slot (5), said slot (5) comprising at least one elevation (8) adapted to engage with an opening on a similar uniting plate to obtain connected uniting plates with their respective flanges in different planes; and a base plate (19), said base plate (19) being substantially planar and having three parallel planes, where the first (117, 119) and third planes (121) are arranged on either side of the second plane (123), where said second plane (123) substantially comprises connection members connecting the first and third plane, whereby a space is obtained between the first and third plane for inserting the flange of the uniting plate, and said base plate (19) comprising at least one means for interaction with one of said at least two flanges (3) of the uniting plate (1), said means for interaction comprising at least two parts, where the at least two parts are in the first and third planes (117 , 119, 121), respectively, such that one of the at least two flanges (3) of the uniting plate is adapted to be placed in the second plane (123).

4. The set of building elements according to claim 3, wherein the uniting plate (1) comprises one or more apertures (7) and that a ridge (127) is provided in the means for interaction (117, 119, 121) in the base plate (19), whereby said aperture (7) engages with the ridge (127) in the base plate (19), whereby said base plate (19) and said uniting plate (1) are releasably locked together.

5. The set of building elements according to claim 4, wherein the set of building elements comprises a first play FIG. (167); said first play FIG. (167) comprises a head (169), two arms (171), two hands (179), two legs (173), and a torso (175); where the hands (179) are formed as flanges which can engage with the one or more apertures (7) of the uniting plate (1); and where the legs (173) are separated by a space (177); said space (177) is shaped complementary to a shape of the head (169) of the first play FIG. (167); and where the first play FIG. (167) can be detachably engaged with another first play figure by placing the head of one first play figure in the space between the legs of another first play figure.

6. The set of building elements according to claim 5, wherein the set of building elements comprises a second play FIG. (189); said second play FIG. 189) comprises at least one head (195) similar to the head of the first play figure, at least one torso (197), at least two legs (193) and multiple arms (191); where spaces (199) are arranged on the second play figure; said spaces (199) are shaped complimentary to the head of the first play FIG. (169); and where the second play FIG. (189) can be detachably engaged with the first play FIG. (167) or another second play figure by placing the head of the first play figure or the other second play figure in a space of the second play figure.

7. The set of building elements according to claim 4, wherein the ridge (127) is arranged on a resilient section (163) of the means for interaction (117, 119, 121) in the base plate (19), and furthermore that a release means (165) for urging the resilient section (163) away from the uniting plate (1) is provided.

8. The set of building elements according to claim 4, wherein the set of building elements comprises a second play FIG. (189); said second play FIG. (189) comprises at least one head (195) similar to the head of the first play figure, at least one torso (197), at least two legs (193) and multiple arms (191); where spaces (199) are arranged on the second play figure; said spaces (199) are shaped complimentary to the head of the first play FIG. (169); and where the second play FIG. (189) can be detachably engaged with the first play FIG. (167) or another second play figure by placing the head of the first play figure or the other second play figure in a space of the second play figure.

9. The set of building elements according to claim 3, wherein at least one building element comprises at least one electronic conductor (239); said at least one electronic conductor being arranged on said at least one building element in an engaging pattern, whereby said at least one electronic conductor (239) on said at least one building element is adapted to engage with at least one electronic conductor (249) on a second building element when combining said first and second building elements.

10. The set of building elements according to claim 9, wherein at least one of said building elements of said set of building elements further comprises a front plate (271) arranged substantially parallel to one of: the first (117, 119) and third (121) plane of said base plate (19).

11. The set of building elements according to claim 3, wherein the connection line (9) comprises flexible material.

12. The set of building elements according to claim 3, wherein the uniting plate (1) comprises ridges (15) arranged parallel to the first connection line (9).

13. The set of building elements according to claim 3, wherein the set of building elements further comprises a corner element (53); said corner element (53) comprises two sub-plates arranged in separate intersecting planes, where the sub-plates each comprises three parallel planes, where the first and third planes are arranged on either side of the second plane, where said second plane is substantially open apart from connection members connecting the first and third plane, and said sub-plates comprises at least one means for interaction (61, 63) with one of the at least two flanges (3) of the uniting plate (1); said means for interaction (61, 63) comprised in said sub-plates comprises at least two parts, where the at least two parts are in the first and third plane, respectively.

14. The set of building elements according to claim 3, wherein the base plate (19) is formed as a rectangle.

15. The set of building elements according to claim 3, wherein building elements in the set of building elements are made from one or more of: plastic, metal, glass, wood, and ceramics.

16. The set of building elements according to claim 3, wherein at least one of said building elements of said set of building elements further comprises a front plate (271) arranged substantially parallel to one of: the first (117, 119) and third (121) plane of said base plate (19).

17. The set of building elements according to claim 3, wherein the set of building elements is used for one or more of: toys, decorative art, and furniture.

* * * * *